United States Patent [19]

Chiu et al.

[11] Patent Number: 4,573,325

[45] Date of Patent: Mar. 4, 1986

[54] SELF-DIAGNOSTIC SYSTEM FOR AN APPLIANCE INCORPORATING AN AUTOMATIC ICEMAKER

[75] Inventors: Norman H. Chiu; David A. Schneider, both of Louisville, Ky.

[73] Assignee: General Electric, Louisville, Ky.

[21] Appl. No.: 692,075

[22] Filed: Jan. 17, 1985

[51] Int. Cl.[4] ..... F25B 49/00

[52] U.S. Cl. ..... 62/129; 62/233

[58] Field of Search ..... 62/126, 127, 129, 125, 62/157, 158, 233, 353, 354, 135, 136, 137, 138, 139, 228.2

[56] References Cited

U.S. PATENT DOCUMENTS

| | | | |
|---|---|---|---|
| 3,480,940 | 11/1969 | Lieser | 340/253 |
| 3,511,059 | 5/1970 | Hoenisch | 62/138 |
| 3,521,264 | 7/1970 | Limon | 340/253 |
| 3,650,121 | 3/1972 | Kimpel et al. | 62/136 |
| 4,142,373 | 3/1979 | Weibel, Jr. et al. | 62/138 |
| 4,238,930 | 12/1980 | Hogan et al. | 62/158 X |
| 4,255,669 | 3/1981 | Naugle | 307/131 |
| 4,292,812 | 10/1981 | Kakinuma et al. | 62/233 X |
| 4,307,775 | 12/1981 | Saunders et al. | 165/11 R |
| 4,387,578 | 6/1983 | Paddock | 62/127 |
| 4,426,851 | 1/1984 | Neumann | 62/126 |

FOREIGN PATENT DOCUMENTS 2543933 4/1977 Fed. Rep. of Germany ..... 62/125

*Primary Examiner*—Harry B. Tanner

*Attorney, Agent, or Firm*—H. Neil Houser; Radford M. Reams

[57] ABSTRACT

Apparatus and a method for detecting fault conditions in an automatic icemaker system of the type having an ice forming mold and an electric motor and mold heater which are energized during ice cube ejection cycles. A current sensor monitors current in the icemaker motor and mold heater circuit and generates an "on" signal when current is detected. A microprocessor measures the duration of the "on" signals and the elapsed time between successive of "on" signals. A diagnostic code is displayed signifying a fault condition in the icemaker circuit when the time between successive "on" signals is less than the normal time required to freeze cubes or the duration of an "on" cycle exceeds the normal ejection time. In a preferred embodiment the microprocessor counts each successive occurrence of a shorter than normal time between ejection cycles and displays the diagnostic code after the detection of three successive shorter than normal times between cycles, so as to avoid unnecessarily alerting the user to isolated short fill occurrences.

10 Claims, 19 Drawing Figures

FIG. 1
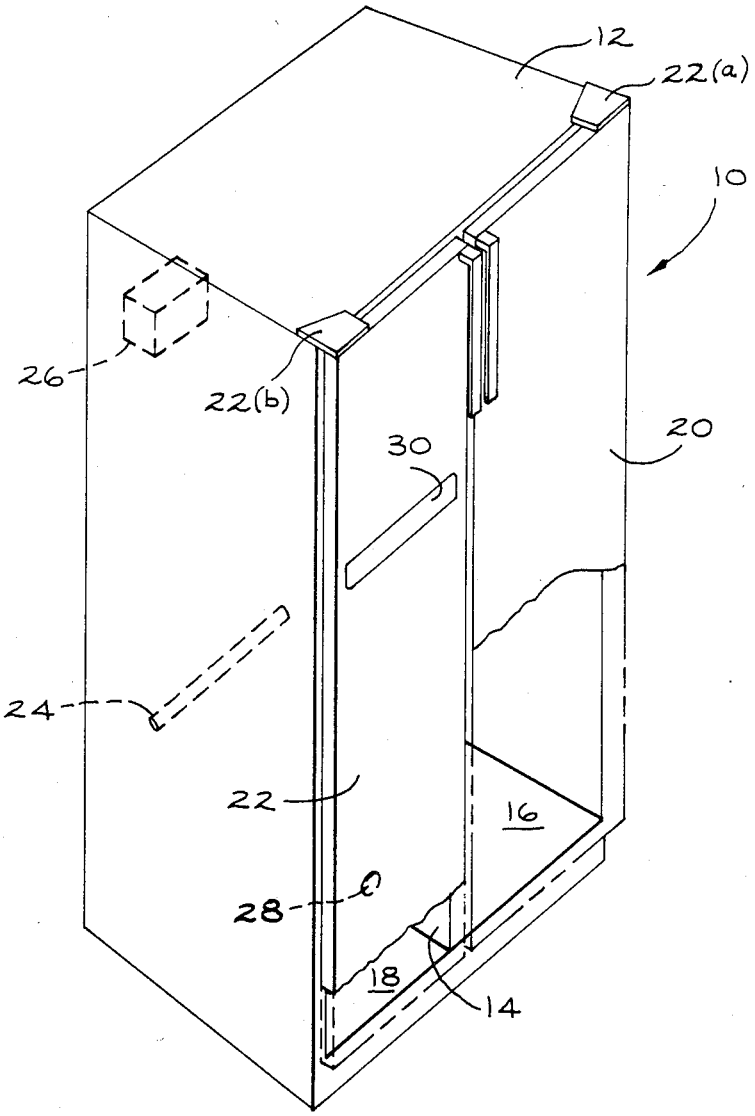
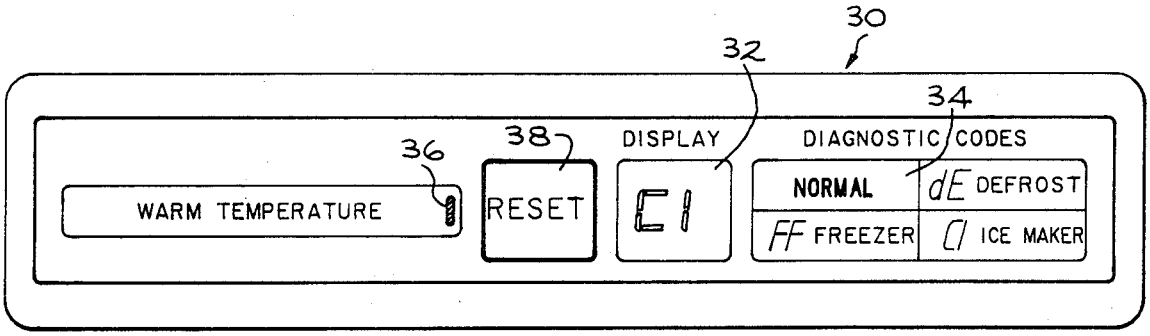
FIG. 2

IM CHECK
342
IS IM FLAG SET ?
NO
YES
344
IS PREV/ON SET ?
YES
NO
348
SET PREV/ON
350
RESET IM TOGGLE
352
RESET CI TIMER → 5 HRS.
346
IS CI TIMER=0 ?
YES
NO
354
IS IM COUNT > 3 ?
NO
YES
SET CI FAULT FLAG
348
356
IS PREV/ON SET ?
NO
YES
360
RESET PREV/ON
362
RESET CI TIMER TO 10 MIN.
358
IS CI TIMER ZERO ?
YES
NO
364
RESET IM COUNT
366
IS IM TOGGLE SET ?
YES
NO
368
SET IM TOGGLE
370
INCREMENT IM COUNT
BRANCH TO PRIORITIZE
372

PRIORITIZE

374
IS FF FLAG SET ?
YES
NO
376
FAULT = 1
378
IS IC FLAG SET
YES
NO
380
FAULT = 2
382
IS DE FLAG SET ?
YES
NO
384
FAULT = 3
386
FAULT = Ø
BRANCH TO RESET KEY
388

SELF-DIAGNOSTIC SYSTEM FOR AN APPLIANCE INCORPORATING AN AUTOMATIC ICEMAKER

BACKGROUND OF THE INVENTION

This invention relates to refrigerator/freezer appliances equipped with automatic icemakers and more specifically to a sensing and diagnostic system for such appliances operative to monitor icemaker operation to detect malfunctions of the icemaker and upon detection to alert the user to the fault condition.

Automatic icemakers are well-known features in domestic refrigerator/freezer appliances. One such device includes a mold for forming cubes, a mold heater for heating the mold to release the cubes, an ejection lever for ejecting cubes from the mold and a sweeper arm for moving the ejected cubes from the mold to a storage basket. A thermostat switch responsive to the temperature in the mold initiates the ejecting cycle when the temperature indicates cubes are frozen. The ejection cycle is initiated by energizing the icemaker motor which drives the ejection lever and sweeper arm as well as actuating various control switches in proper sequence during the ejection cycle including a switch to energize the fill valve solenoid for a predetermined fill time.

Two types of icemaker malfunctions which may occur include blocking or jamming of the eJection lever or sweeper arm and insufficient water fills. The former malfunction causes the motor to stall which in addition to halting ice cube production also results in the motor and defrost heater remaining energized. If the condition persists the temperature in the freezer compartment the heat from the motor and heater may raise to an undesirable level.

If a problem in the fill valve or water inlet line prevents sufficient water from entering the mold during fill, the ice cubes, if any, will be undesirably small and the icemaker will cycle frequently resulting in reduced operating efficiency.

It is desirable therefore to provide a sensing and diagnostic arrangement which would detect such malfunctions of the icemaker and alert the user to the existence of the fault.

It is therefore an object of the present invention to provide an icemaker diagnostic arrangement which monitors the icemaker circuit to detect improper operation thereof and provide a user discernible signal signifying the detection of a fault condition which is preventing normal icemaker operation.

SUMMARY OF THE INVENTION

Apparatus and a methcd are provided for detecting fault conditions in an automatic icemaker system of the type having an ice forming mold and an electric motor and mold heater which are energized by an external power supply during ice cube ejection cycles initiated upon detection of frozen cubes in the mold and de-energized upon completion of the ejection cycle.

In accordance with one aspect of the present invention a current sensor is provided to monitor current in the icemaker motor and mold heater circuit and to generate an "on" signal when current is detected. The current sensor is coupled to logic circuit means including timer means operative to measure the elapsed time between successive of "on" signals and signal means operative to generate a user discernible signal signifying a fault condition when the time between successive "on" signals is less than the normal time between ejection cycles. By this arrangement faults causing an inadequate fill, characterized by shorter than normal times between ejection cycles are detected and the user is alerted.

In accordance with another aspect of the invention the timer means is also operative to measure the duration of the "on" signals and the signal means is operative to generate a user discernible signal when the "on" signal duration is greater than a predetermined reference time. By this arrangement faults causing the icemaker motor to stall characterized by longer than normal ejection cycle time are detected and the user is alerted to the fault condition. In a preferred form of the invention, the logic circuit means includes means for counting each successive occurrence of a shorter than normal time between ejection cycles and the signal means is operative to generate the user discernible signal after the detection of a predetermined number of successive shorter than normal times between cycles, so as to avoid unnecessarily alerting the user to isolated occurrences.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 1 is a perspective view of a two door side-by-side refrigerator/freezer with portions of the doors broken away to show the interior of the fresh food and freezer compartments and showing in schematic fashion the temperature sensor, defrost heater and icemaker located in the freezer compartment;

FIG. 2 is an enlarged view of the control and display panel mounted on the freezer door in the refrigerator of FIG. 1;

DETAILED DESCRIPTION

Figure 3:
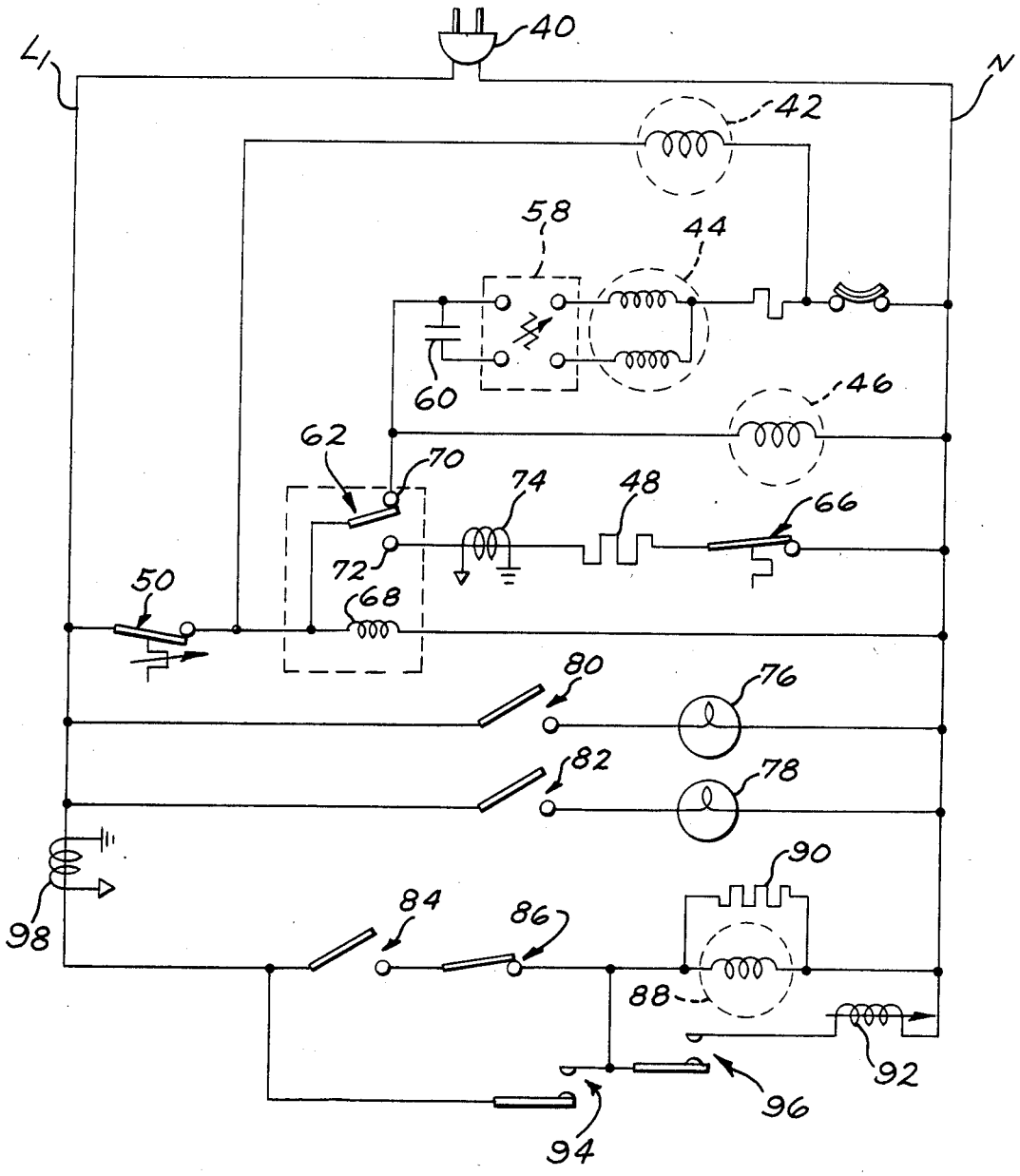
FIG. 3 is a simplified schematic diagram of the main power circuit for the refrigerator of FIG. 1.

Referring now to FIG. 1 there is shown a side-by-side refrigerator/freezer 10 including a cabinet 12 having a divider wall 14 separating the interior of the cabinet into a fresh food compartment 16 and a freezer compartment 18. Fresh food compartment 16 is enclosed by fresh food door 20 conventionally hinged on the right side by hinges 20(*a*) and freezer compartment 18 is enclosed by freezer door 22 conventionally hinged on the left side by hinges 22(*a*). Enclosed within the freezer compartment is a conventional defrost heater shown schematically at 24 which is mounted to and runs horizontally across the rear wall of freezer compartment 18 approximately mid-way between the top and bottom of the compartment and an automatic icemaker shown schematically at 26 located in the upper rear portion of the freezer compartment. A temperature sensor for monitoring the temperature within the freezer compartment is shown schematically at 28 mounted to the interior face of freezer door 22.

Refrigerator/freezer 10 is provided with a diagnostic sensing and display system which monitors the operation of various appliance operating conditions and provides diagnostic signals to the user, informing the user of certain faults or abnormal operating conditions. In accordance with the present invention the diagnostic sensing and display system monitors the current flow in the icemaker circuit and measures the duration of off times and on times to detect fault conditions signified by measured on or off times which are outside of normal operating time limits. Upon detection of a fault the icemaker fault diagnostic fault code is visually displayed to inform the user that a fault has been detected in the icemaker circuit.

The sensing and display system of the illustrative embodiment also monitors the temperature in the frozen food compartment to alert the user to the existence of undesirable over-temperature conditions in the freezer, as described and claimed in commonly assigned co-pending U.S. patent application Ser. No. 692,081, filed Jan. 17, 1985, which is hereby incorporated by reference; and monitors the defrost current to alert the user to a fault in the defrost circuit, as described and claimed in commonly assigned co-pending U.S. patent application Ser. No. 692,099, filed Jan. 17, 1985, which is hereby incorporated by reference.

A control and display panel 30 for the diagnostic sensing and display system is provided on the outer face of freezer door 22. As best seen in FIG. 2 control panel 30 includes a two-digit LED display 32, a back-lit "normal" display indicator 34, a Warm Temperature indicator light 36, and a manually actuable reset key 38. As defined on the control panel adjacent display 32, the diagnostic fault codes FF, DE and CI are employed to indicate abnormal operating conditions having been detected for the freezer, the defrost heater circuit and the icemaker circuitry respectively. The CI shown in display 32 for illustrative purposes signifies that a fault has been detected in the icemaker circuit which is preventing it from operating properly.

The main power circuit for refrigerator/freezer 10, which includes the compressor motor, the condenser fan motor, the evaporator fan motor, the defrost heater and the icemaker circuitry comprising essentially a motor, mold heater and fill valve solenoid, is illustrated schematically in FIG. 3. Power is applied to the circuit via lines L1 and N which are adapted for connection to a standard 60 Hz 120 volt AC domestic power receptacle by plug 40. Condenser fan motor 42 is connected between L1 and N in series with thermostat switch 50 and thermal cut-out switch 52. The compressor motor circuit, comprising motor start winding 54 and run winding 56, a positive temperature coefficient relay switch 58 and run capacitor 60 is connected to L1 through defrost timer controlled switch 62 and temperature control thermostat switch 50. The other side of the compressor motor circuit is connected to N through an over-current protection fuse 64 and thermal cut-out switch 52. One side of the evaporator fan motor 46 is connected to L1 through defrost timer switch 62 and thermostat 50, with the other side connected directly to N. Defrost timer switch 62 is normally closed across compressor circuit contact 70 as shown, except during defrost cycles as will be hereinafter described. Thus, energization of the compressor circuit is controlled by temperature control thermostat 50.

Defrost heater 48 is connected to L1 through defrost timer switch 62 and thermostat 50 and to N through defrost thermostat switch 66. Defrost timer motor winding 68 is connected between L1 and N in series with temperature control thermostat switch 50. Defrost timer switch 62 is actuated by a cam (not shown) driven by the defrost timer motor to initiate and terminate the defrost cycle. The cam is adapted to close switch 62 across defrost heater contact 72 to initiate defrost after approximately twelve hours of timer motor run time and to maintain the switch in this position for approximately 30 minutes of motor run time before reclosing the switch across compressor circuit contact 70. However, the heater remains energized only until the defrost thermostat 66 opens which normally occurs before switch 62 opens. The defrost thermostat senses the temperature of the evaporator coils (not shown) which temperature rises rapidly when the frost is removed.

A current sensor in the form of a current transformer winding 74, used in the sensing circuitry to be hereinafter described, is positioned to detect current flow in the defrost heater circuit.

A freezer compartment light 76 and a fresh food compartment light 78 for illuminating the interior of the refrigerator are connected in parallel across L1 and N. Energization of these lights is controlled by door actuated switches 80 and 82 respectively which are closed when the respective compartment doors are opened and vice versa.

The icemaker circuit, connected across L1 and N, comprises feeler arm switch 84, mold thermostat switch 86, icemaker motor 88, mold heater 90, water valve solenoid 92 and icemaker motor controlled, cam-actuated switches 94 and 96. One side of icemaker motor 88 is connected to L1 through mold thermostat switch 86 and feeler arm switch 84. Mold heater 90 is connected in parallel with motor 88. Cam actuated switch 94 controlled by motor 88 is operative when closed to shunt feeler arm switch 84 and mold thermostat 86. Icemaker water valve solenoid 92 and serially connected cam actuated switch 96 are connected in parallel with motor 88. Structural details of a suitable icemaker apparatus is described in U.S. Pat. Nos. 3,163,017 to Baker et al and 3,163,018 to Shaw which are hereby incorporated by reference. A current sensor comprising current transformer winding 98, also used in the sensing circuitry to be hereinfter described, is positioned to sense current flow in the icemaker circuitry.

Figure 4:
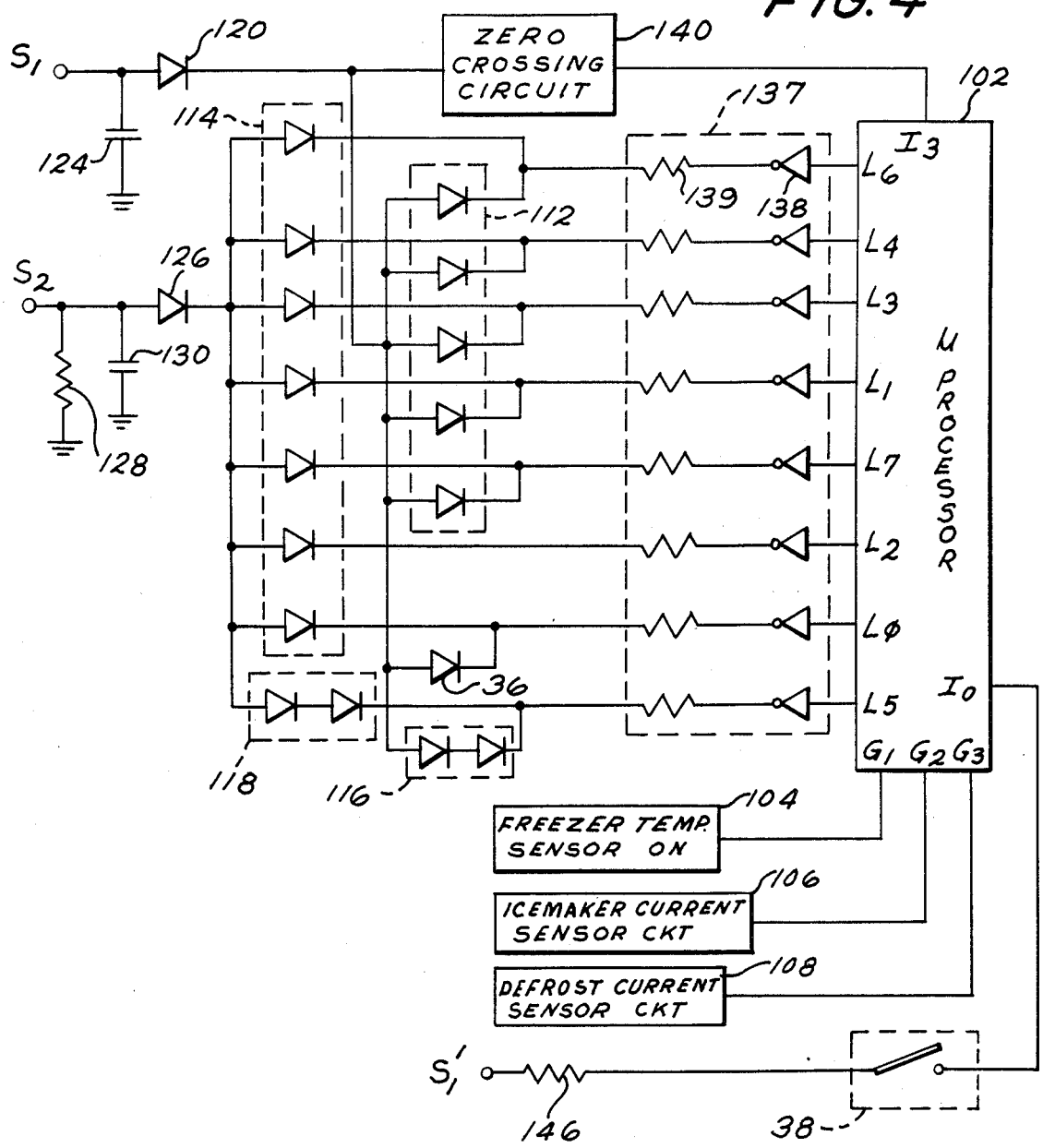
FIG. 4 is a simplified schematic diagram of the electronic sensing and display circuit for the refrigerator of FIG. 1.

The sensing and display system circuitry for refrigerator/ freezer 10 which illustratively embodies the present invention is shown schematically in FIG. 4. The primary control component in the circuit is microprocessor 102 which receives input signals from freezer temperature circuit 104, icemaker current sensing circuit 106, and defrost current sensing circuit 108; processes these inputs in accordance with a control program to be hereinafter described; and generates output signals for controlling the control panel display means comprising warm temperature LED 36, the NORMAL indicator 34 and the two-digit diagnostic code display 32 (FIG. 2).

It will be recalled that a primary object of the present invention is to provide a warning system which will detect various malfunctions of the icemaker and generate an appropriate user discernible warning signal. The normal icemaker operating cycle is divided into five phases: freeze; release; eject; sweep and water fill. Normally, feeler arm switch 84 is closed at the beginning of the cycle and the cube forming mold (not shown) is filled with water. Thermostat switch 86 is positioned to sense when the water in the mold has frozen. When the water is frozen, switch 86 closes, energizing motor 88 and mold heater 90. Motor 88 moves an ejection lever (not shown) to eject the newly formed cubes from the mold. Typically, motor 88 stalls after a brief rotation until the mold heater has warmed the mold sufficiently to release the cubes; however, the initial movement of the motor prior to stalling rotates a cam (not shown) sufficiently to close switch 94 which shunts thermostat 86 to maintain motor energization.

Following ejection of the cubes, cam switch 96 is closed to energize the valve solenoid 92. After a timed fill period controlled by motor 88 switch 96 opens. Since thermostat switch 86 is now open, the cycle ends when cam actuated switch 94 opens de-energizing motor 88.

Two basic types of failures of the icemaker are of particular concern, ejection malfunctions and fill malfunctions. Ejection malfunctions cause the icemaker motor 88 to become stalled. Such a malfunction may occur if a partially ejected cube were to become jammed between the sweeper arm and the mold, or if the ejection lever were to become stuck. If the motor remains in a stalled condition for a prolonged period of time, the heat generated by the mold heater and the motor itself, in addition to damaging the motor itself, could also raise the temperature in the freezer compartment to undesirable levels.

Normally, the typical ejection cycle requires approximately 3–6 minutes. Thus, an on time for the icemaker circuit greater than 6 minutes is suggestive of a fault condition which is precluding completion of an ejection cycle. However, many such conditions are self-correcting with time. For example, a piece of ice jammed between the sweeper arm and the mold may melt enough to unjam due perhaps to opening of the freezer compartment or the occurence of a defrost cycle or possibly due to heat from the mold heater and stalled motor. Thus, it is not necessary and in fact is a potential nuisance to call the user's attention to every ejection cycle time which exceeds the normal ejection time. In accordance with the present invention a reference time is selected which is long enough to allow most self-correctable stalling conditions to do so, yet short enough to prevent damage from the heat generated by the mold heater and motor. In the illustrative embodiment, a reference time on the order of five hours has been found to provide suitable results. Based upon empirical observations it is believed that fault conditions causing the motor to stall for more than five hours are highly unlikely to be corrected without user intervention. Also with the icemaker of the illustrative embodiment a stalled condition can, with a normal load of items being refrigerated in the freezer compartment, tolerate a stalled condition for up to approximately 10 hours without adverse effects on the icemaker or the refrigerated items. Thus the five hour reference time allows the user adequate time to notice the display and take appropriate corrective action before any damage results from the fault. It will be appreciated that the appropriate reference time is influenced by a number of freezer and icemaker design factors and thus should be empirically determined for particular icemaker and freezer configurations.

The fill category of icemaker faults involves too little or no water being supplied to the mold. As hereinbefore described, the fill is timer controlled and the ejection cycle is initiated by a mold thermostat which initiates an ejection cycle when the mold temperature sensed by the thermostat indicates that the water in the mold has frozen. When the proper amount of water has been delivered to the mold, the time required for the water to freeze into cubes varies considerably under the influence of a number of factors including freezer temperature, incoming water temperature, and mold size. However, for a given icemaker and freezer configuration the minimum time required to freeze the normal volume of water is reasonably predictable based upon empirical observation. In the illustrative embodiment a minimum of 15–20 minutes is required to freeze a normal charge of water in the mold.

However, if the fill is less than normal, such as might result from a blockage in the water inlet supply line or a defective solenoid valve, etc., the freeze time may be significantly less.

In accordance with the present invention the time between ejection cycles is measured and compared to a reference time less than the normal freeze time. A time between cycles less than this minimum reference time is symptomatic of a fault in the icemaker fill system. In the illustrative embodiment a reference time of ten minutes has been found to provide satisfactory results.

A user discernible warning signal could be generated upon a single detection of such a condition. However, in the illustrative embodiment in accordance with a preferred form of the invention the warning signal is generated only afer detecting a predetermined number of consecutive abnormally short freeze times. In the illustrative embodiment this number is somewhat arbitrarily set at 3. The reason for requiring more than one consecutive short freeze times before generating a warning signal is to avoid responding to isolated occurrences.

As will be hereinafter described in greater detail, icemaker current sensor circuit 108 is operative to generate an output signal which indicates whether the icemaker circuitry is energized or de-energized. Microprocessor 102 includes logic circuitry responsive to the signal from circuit 108 and operative to measure the duration of the energized or "on" periods to detect on periods greater than five hours and to measure the time between on periods to detect off times less than 10 minutes. Microprocessor 102 generates output signals to which are coupled display means, triggering the display means to generate a user discernible signal alerting the user to a fault condition in the icemaker circuit, upon detection of an on period greater than five hours or three consecutive off periods of less than 10 minutes each. In the illustrative embodiment the displaymeans comprises LED display 32 which displays the icemaker fault code, CI.

As will be hereinafter described in detail, defrost current sensor circuit 108 is operative to provide a signal to microprocessor 102 indicative of whether or not current is flowing in the defrost heater. Microprocessor 102 includes logic circuitry arranged to monitor the duration of time between successive defrost heater "on" times and to generate an appropriate output signal to the display circuitry indicative of a defrost fault if this time is greater than a predetermined reference time preferably on the order of 48 hours. In response display 32 displays the characters DE signifying a fault has been detected in the defrost circuit.

The function of the over-temperature warning feature of the sensing and display system is to detect a first over-temperature condition (characterized by an effective ambient freezer temperature in the 30° F.–50° F. range) and a second over-temperature condition (characterized by an effective ambient freezer temperature greater than 50° F.) and generate a Warm Temperature signal if the first condition continues for more than four hours or the second condition continues for more than one hour. This signal indicates to the user that temperature conditions exist in the freezer which, if allowed to continue, could result in damage to refrigerated items. In addition, a frozen food fault code FF is displayed if the first condition continues for more than six hours or the second condition continues for more than 2 hours, which alerts the user to a fault condition which may have already damaged refrigerated items. The Warm Temperature signal is discontinued when the freezer temperature returns to below 30° F. However, the fault code remains on until terminated by user actuation of reset key 38.

Due primarily to the mounting of the temperature sensor in a housing on the freezer door, a temperature differential on the order of +5° F. has been observed between the temperature in the immediate vicinity of temperature sensor and the ambient temperature in the central region of freezer compartment for this model. The former is hereinafter referred to as the sensed freezer temperature and the latter as the effective ambient freezer temperature. Hence, the sensed freezer temperature will be roughly 5° F. higher than the effective ambient freezer temperature, and the reference temperatures employed for detecting malfunctions are set at 5° F. higher than the desired effective ambient freezer temperature limits.

The display means for the sensing and display circuitry in FIG. 4 comprises a five segment parallel LED array 112 which comprises the right hand digit in display 32 (FIG. 2); a seven-segment LED array 114 which comprises the left-hand digit in display 32; two two-segment LED arrays 116 and 118 which provide backlighting for Normal indicia 34; and LED 36 which comprises the Warm Temperature indicator (FIG. 2). The arrays are energized by low voltage half-wave rectified AC signals applied to terminals $S_1$ and $S_2$. $S_1$ is coupled to the anode terminal of each of the LED segments in array 112 via isolating diode 120. Array 112 is enabled when the signal at $S_1$ is positive. Bypass capacitor 124 is connected between $S_1$ and ground. $S_2$ is similarly coupled to the anode of each LED segment in seven segment parallel array 114 via isolating diode 126. $S_2$ is effective to enable array 114 when the signal at $S_2$ is positive. Resistor 128 and bypass capacitor 130 are connected between $S_2$ and ground. Resistor 128 is provided to balance loads so that waveforms at $S_1$ and $S_2$ are symmetric.

Figure 5A:
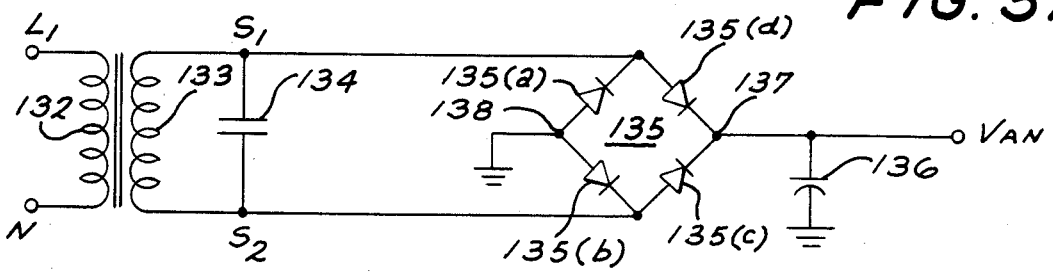
FIG. 5A and 5B are schematic circuit diagrams for the low voltage power supply for the circuits of FIG. 4.
Figure 6:
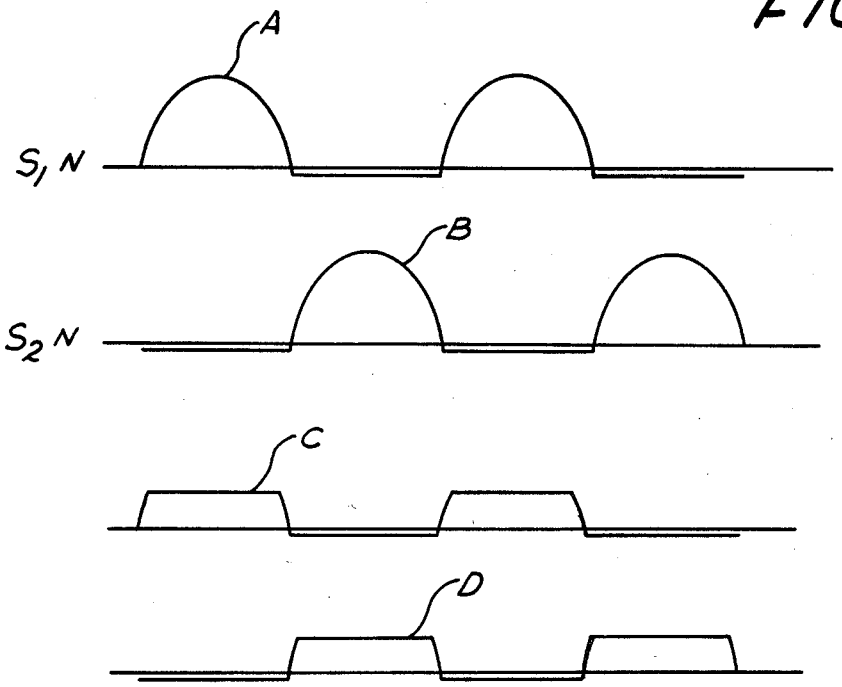
FIG. 6 is a graphical representation of the low voltage power signals from the power supply of FIG. 6.

The signals applied at $S_1$ and $S_2$ are derived from the dc power supply circuitry illustrated in simplified schematic form in FIG. 5A. A step down transformer 131 has its primary winding 132 connected across $L_1$ and N. The terminals of secondary winding 133 are designated $S_1$ and $S_2$. The stepped down voltage is converted to a dc signal $V_{AN}$ via bypass high frequency capacitor 134 connected across $S_1$ and $S_2$ in parallel with full-wave rectifying diode bridge 135 comprising diodes 135(*a*), 135(*b*), 135(*c*) and 135(*d*). Electrolytic filter capacitor 136 is coupled between bridge output terminal 137 and ground. The other bridge output terminal 138 is connected directly to ground. Waveforms A and B of FIG. 6 represent the voltage between $S_1$ and ground (N) and $S_2$ and ground (N) respectively. Diode 135(*a*) limits the negative swing of the voltage at $S_1$ to one diode drop (0.6 volts) negative with respect to ground. Similarly, diode 135(*b*) limits the negative swing of the voltage at $S_2$ to one diode drop negative with respect to ground. The voltage signal between $S_1$ and ground is 180° out of phase with the voltage across $S_2$ and ground resulting in display arrays 112 and 114 being enabled during alternate half-cycles of the 60 Hz power signal across L1 and N. The two segment serial LED arrays 116 and 118 are similarly coupled to $S_1$ and $S_2$ respectively and alternately enabled.

Referring again to FIG. 4, microprocessor output ports $L_0$–$L_7$ provide output signals for controlling the LED arrays. These signals are coupled to the cathode terminals of the LEDs in each array by driver circuitry 137. Driver circuitry 137 comprises an open collector driver 138 and a current limiting resistor 139 for each of microprocessor output ports $L_0$–$L_7$. Each output port is coupled to the input terminal of its associated open collector driver. The collector terminal of each driver is coupled by serially connected current limiting resistor 139 to the cathode terminal of its associated LED segments. Each of output ports $L_1$, $L_3$, $L_4$, $L_6$, and $L_7$ is coupled to two associated LED segments, one in each of arrays 112 and 114. $L_2$ is coupled only to an associated LED in array 114. $L_0$ is coupled to an LED segment in array 114 and to the Warm Temperature LED 36. LED 36 has its anode connected to $S_1$ via isolating diode 120. $L_5$ is coupled to LED arrays 116 and 118.

Zero crossing detector circuit 140 monitors the signal at $S_1$ and provides a logic high or one signal at microprocessor input port $I_3$ when the voltage at $S_1$ is positive with respect to ground and a logic low or zero signal at $I_3$ when the voltage at $S_1$ is negative with respect to ground, to synchronize the processing of input and output signals.

The appropriate LED segments are energized by providing a logic high output signal at the appropriate ones of output ports $L_0$–$L_7$. This provides a current path to ground through the collector terminal of the associated open collector driver devices. The microprocessor outputs the correct code for the LED segments coupled to $S_1$ during the positive half-cycles of the signal at $S_1$ and the correct code for the LED segments coupled to $S_2$ during the positive half-cycles of the signal at $S_2$. The state of the input at $I_3$ signifies to the microprocessor which half-cycle is in progress at any point in time.

This unique duplexing arrangement for controlling the display provides the advantages of a conventional multiplex arrangement using fewer discrete resistors and transistors and fewer microprocessor I/O lines and also reduces the loading requirement for the filtered dc power supply. This arrangement is the subject of commonly assigned co-pending U.S. patent application Ser. No. 692,085, filed Jan. 17, 1985.

In addition to the power signal phase indicating signal received at input port $I_3$ from zero crossing circuit 140, microprocessor 102 also receives input signals from sensors monitoring various refrigeration system operating parameters and user inputs. Specifically, input signals from freezer temperature sensor circuit 104, icemaker current sensor circuit 106 and defrost current sensor circuit 108 are coupled to input ports G1, G2 and G3 respectively. Sensor circuits 104–108 are shown in greater detail in FIGS. 7A–7C respectively yet to be described.

The status of the user actuable reset key 38 (FIG. 2) is signified by the signal coupled to input port $I_0$. Reset key 38 comprises a normally open tactile membrane switch, serially connected to current limiting resistor 146. Resistor 146 and switch 38 are connected between input port $I_0$ and $S_1$. User actuation of switch 38 is signified by a logic high signal applied to input port $I_0$ when the voltage at $S_1$ is positive with respect to ground.

Figure 7A:
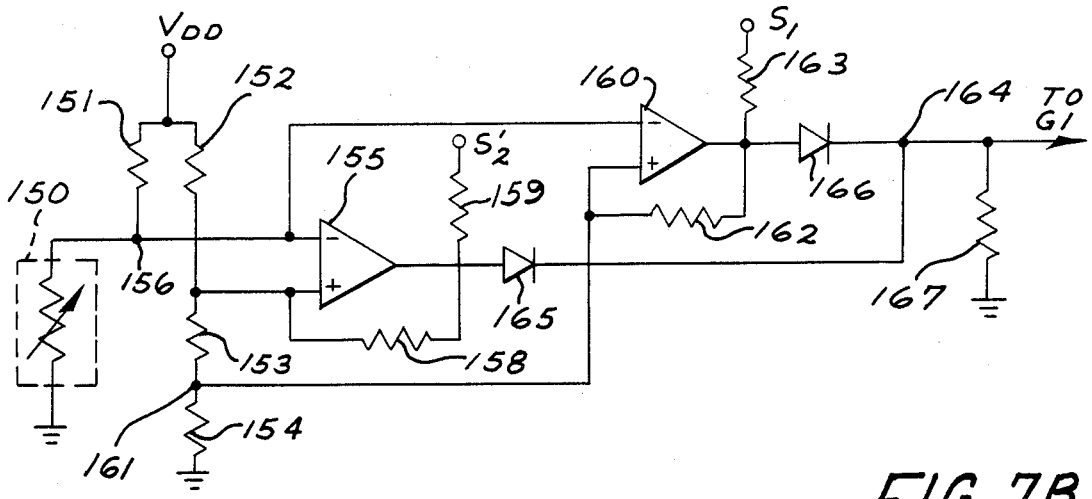
FIGS. 7A, 7B and 7C are detailed schematic diagrams of the temperature sensor circuit, icemaker current sensor circuit and defrost current sensor circuit portions respectively of the circuit of FIG. 4.
Figure 7B:
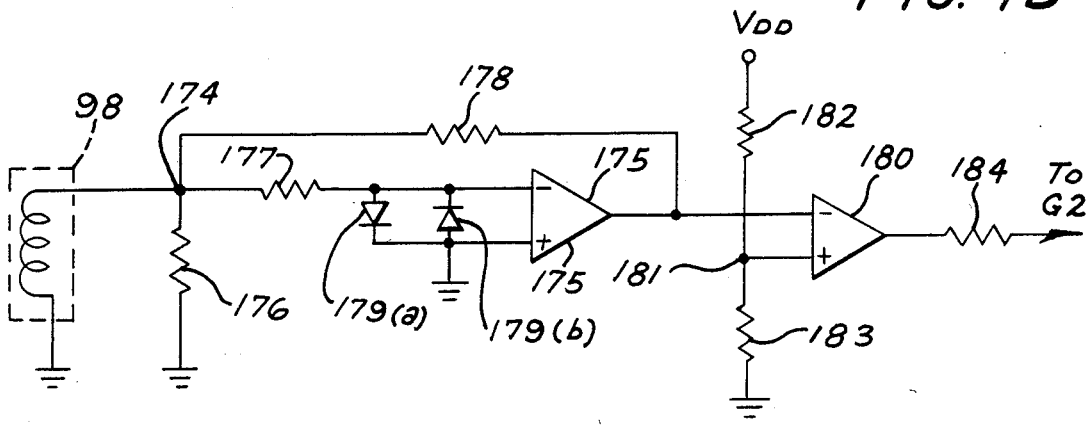
Figure 7C:
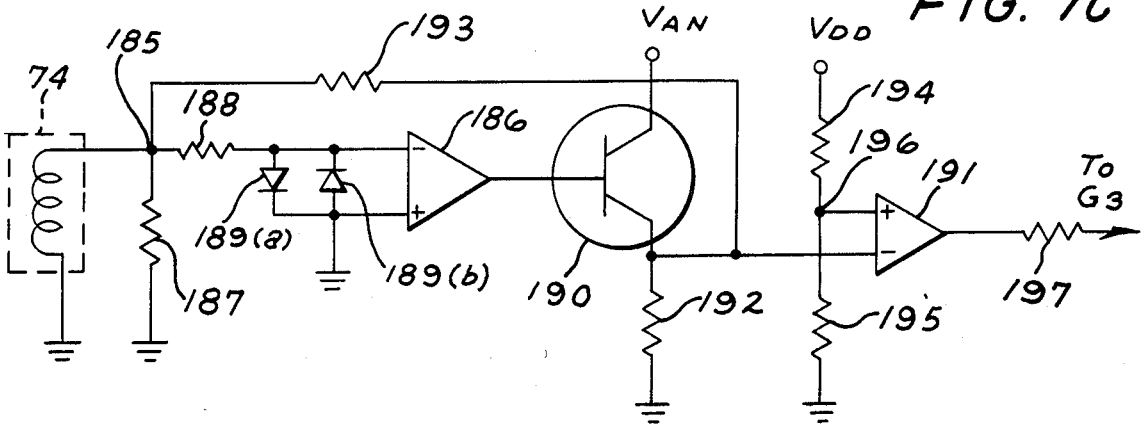

Referring now to FIGS. 7A–7C, the sensing circuits 104, 106 and 108 will be described in greater detail beginning with temperature sensing circuit 104. Temperature sensing circuit 104 includes sensor means comprising a negative temperature coefficient thermistor 150 connected in a voltage divider bridge network comprising fixed resistors 151, 152, 153 and 154. Regulated DC voltage signal $V_{DD}$ biases the bridge network. A first voltage comparator 155 compares the voltage across thermistor 150 to a first reference voltage representative of a first reference temperature. A second voltage comparator 160 compares the voltage across thermistor 150 to a second reference temperature.

Considering first comparator 155, junction 156 between thermistor 150 and resistor 151 is connected to its inverting input. Junction 157 between resistors 152 and 153 is connected to its non-inverting input. Feedback resistor 158 is connected between the comparator output and its non-inverting input. A pulse train, synchronized with the signal at $S_1$, is applied at terminal $S_1'$ and coupled to the output of comparator 155 via pull-up resistor 159. The voltage at the junction 156 represents the sensed temperature in freezer compartment 18 (FIG. 1). Resistors 152, 153 and 154 are selected such that the voltage at junction 157 represents a first threshold temperature, which is preferably on the order of 35° F. The output of comparator 155 is pulled up to the voltage at $S_1'$ when the voltage at junction 156 is less than the voltage at 157, signifying a sensed freezer temperature greater than 35° F. and is at system ground corresponding to a logic zero level when the voltage at junction 156 is greater than the voltage at junction 157, signifying a sensed freezer temperature less than 35° F.

Similarly, junction 156 is connected to the inverting input of comparator 160. Junction 161 between resistors 153 and 154 is connected to the non-inverting input of comparator 160. Feedback resistor 162 is connected between the output of comparator 160 and its non-inverting input. A pulse train applied at $S_2'$, which is synchronized with the voltage at $S_2$, is coupled to the output of comparator 160 via pull-up resistor 163. Resistors 152, 153 and 154 are also selected such that the voltage at junction 161 represents a second predetermined threshold temperature higher than the first reference temperature. Preferably this second reference temperature is on the order of 55° F. When the voltage at junction 156 is greater than that at 161, signifying a sensed freezer temperature less than 55° F., the output of comparator 160 is at system ground corresponding to a logic zero level. When the voltage at junction 156 is less than that at 161, signifying a sensed freezer temperature greater than 55° F., the output of comparator 160 is pulled up to $S_2'$. The outputs of comparators 155 and 160 are coupled in wired OR fashion at 164 via diodes 165 and 166 respectively. Junction 164 is coupled to microprocessor input port G1 (FIG. 4) and to system ground via resistor 167.

It will be recalled that freezer temperature sensor circuit 104 is to detect three temperature conditions: sensed freezer temperature less than 35° F.; sensed freezer temperature greater than 35° F. but less than 55° F.; and sensed freezer temperature greater than 55° F. These three conditions are signified using a single two-state output line by alternately enabling comparators 155 and 160 and programming microprocessor 102 to properly process the input signal received at G1. Comparators 166 and 160 are effectively enabled by the pulse trains applied at $S_1'$ and $S_2'$ respectively.

Figure 5B:
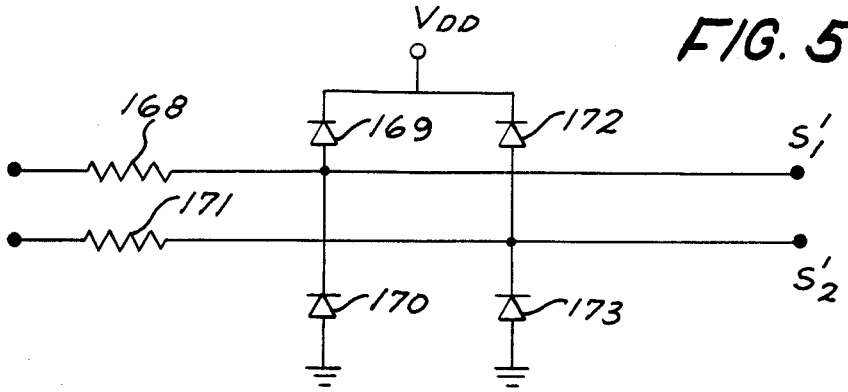

The circuitry for generating the pulse trains at $S_1'$ and $S_2'$ is illustrated in FIG. 5B. $S_1'$ is connected to $S_1$ via voltage dropping resistor 168. Clamping diodes 169 and 170 clamp the voltage at $S_1'$ to one diode drop greater (0.6 volts) than regulated positive dc voltage $V_{DD}$ and one diode drop less than system ground respectively. Similarly, $S_2'$ is connected to $S_2$ via resistor 171 and clamped to $V_{DD}$ and ground by diodes 172 and 173 respectively. $V_{DD}$ is derived from $V_{AN}$ by conventional voltage regulator circuitry not shown. The resultant waveforms are shown in FIG. 6. Waveforms C and D represent the voltage at $S_1'$ with respect to ground and $S_2'$ with respect to ground respectively.

It is apparent from waveforms C and D (FIG. 6) that the voltages at $S_1'$ and $S_2'$ are positive with respect to ground during opposite half-cycles of the 60 Hz power signal. As will be hereinafter described, microprocessor 102 is programmed to store the inputs received at the G input ports when $S_1$ and $S_1'$ are positive in a Phase 1 input register and inputs received when $S_2$ and $S_2'$ are positive at a Phase 2 input register, and to decode the G1 bit in the Phase 1 and Phase 2 input registers as follows. A logic zero at G1 when $S_1'$ is zero and when $S_2'$ is zero signifies a freezer temperature less than 35° F.; a logic one at G1 when $S_1'$ is high and a logic zero when $S_2'$ is high signifies a temperature greater than 35° F. and less than 55° F.; and a logic one at G1 when $S_2'$ is high signifies a freezer temperature greater than 55° F.

The icemaker current sensing circuit 106 (FIG. 4) is shown in simplified schematic form in FIG. 7B. It will be recalled that the function of sensing circuit 106 is to monitor current flow in the icemaker circuit and generate an output signal which indicates whether the icemaker circuit is energized. Current transformer winding 98 as hereinbefore described with reference to FIG. 3, senses the current flowing in the icemaker motor and mold heater circuit. One terminal of winding 98 is connected to ground. The other designated 174 is connected to the inverting input of op amp 175 via stabilizing resistor 176 and current limiting resistor 177. Resistor 176 is connected between winding terminal 174 and ground to provide a low resistance path for noise and transients w3hen winding 98 is not drawing current. Resistor 177 couples winding terminal 174 to the inverting input of op amp 175. Feedback resistor 178 couples the output of op amp 175 to terminal 174. Oppositely poled diodes 179(*a*) and 179(*b*) are coupled between the inverting input of op amp 175 and its grounded non-inverting input to minimize noise and transients effects. By this arrangement the output voltage for op amp 175 is proportional to the current sensed by winding 98.

The output of op amp 175 is coupled to the inverting input of comparator 180. The inverting input of comparator 180 is connected to the junction 181 between resistors 182 and 183, which are serially connected between dc suppl $V_{DD}$ and ground, to provide a reference voltage at the non-inverting input. The output of comparator 180 is coupled to input port G2 of microprocessor 102 via current limiting resistor 184. The circuit parameters are selected such that when no current is flowing in the icemaker circuit, the voltage at the inverting input of comparator 180 is less than the reference resulting in a logic high signal being applied to G2. Normal operating current in the icemaker circuitry causes the voltage at the inverting input of comparator to exceed the reference voltage internally grounding the output of the comparator resulting in a logic low or zero signal being applied to G2. As will be hereinafter described, microprocessor 102 is programmed to recognize a logic zero input at G2 as signifying that the icemaker circuitry is energized, and a logic one signal as signifying that it is de-energized.

The defrost current sensor circuit 108, shown schematically in FIG. 7C, is very similar to icemaker current sensor circuit 106. The function of circuit 108 is to monitor current flow in the defrost circuit and generate an output signal which indicates whether the defrost heater is energized. As hereinbefore described with reference to FIG. 4, current transformer winding 74 senses current flowing in defrost heater 48. One terminal of winding 74 is connected to ground; the other designated 185 is connected to the inverting input of op amp 186 via stabilizing resistor 187 and current limiting resistor 188. Resistor 187 is connected between winding terminal 185 and ground to provide a low resistance path for noise and transients when winding 74 is not drawing current. Resistor 188 couples winding terminal 185 to the inverting input. Oppositely poled diodes 189(*a*) and 189(*b*) are connected beween the inverting input and the grounded non-inverting input to minimize noise and transient effects. At this point, the circuit of FIG. 6C differs slightly from FIG. 7B, due to the substantially greater current drawn by the defrost heater relative to that drawn by the icemaker circuit. The defrost heater current during defrost cycles causes the secondary current required by current transformer winding 74 to exceed the current capability of op amp 186. Driver transistor 190 is coupled in emitter follower configuration between the output of op amp 186 and the inverting input of comparator 191 to provide the additional current gain required. Specifically, the output of op amp 186 is coupled to the base of transistor 190. Supply voltage $V_{AN}$ is connected to the collector and resistor 192 couples the emitter to ground. The emitter is also connected to the inverting input of comparator 191 and to junction 185 via feedback resistor 193. A voltage divider comprising serially connected resistors 194 and 195 coupled between $V_{DD}$ and ground provide a reference voltage at junction 196 which is connected to non-inverting input of comparator 191. The output of comparator 191 is coupled to G3 of microprocessor 102 by current limiting resistor 197.

By this arrangement the voltage at the inverting input of comparator 191 is proportional to the sensed defrost heater current. When the heater is de-energized, the voltage at the inverting input of comparator 191 is less than the reference voltage at the non-inverting input resulting in a logic high signal being applied to input port G3. When the defrost heater is energized, the current induced in winding 74 is sufficient to raise the voltage at the inverting input of comparator 191 above the reference voltage, grounding the comparator output resulting in a logic low signal being applied to input port G3. As will be hereinafter described, microprocessor 102 is programmed to recognize a logic zero at input port G3 as signifying that the defrost heater is energized and a logic one as signifying that the defrost heater is de-energized.

The following components and component values are believed suitable for use in the sensor and display circuit of FIGS. 4, 5A, 5B, and 7A–7C.

TABLE I

| Microprocessor | | Fixed Resistors - Ω | |
|---|---|---|---|
| 102 COPS 420L (National Semiconductor) | | 176,187 | 10 |
| Integrated Circuits | | 193 | 75 |
| 155,160 | LM 339 | 139 | 220 |
| 175,186 | LM 2902 | 178 | 390 |
| | | 177,188 | 1K |
| 180,191 | | 153 | 3.09K |
| 138 | ULN 2004A | 146,152,154, 159,163,168, 171,184,192, 197 | 10K |
| LEDs | | | |
| Arrays 112,114 | TLG 321 (Toshiba) | | |
| Arrays 128,130 | TLG 251 (Toshiba) | | |
| 38 | SLR-34 (Rohm) | 167 | 15K |
| Diodes | | 183,195 | 27K |
| 120,126 | | 182,194 | 36K |

TABLE I-continued

| | | | |
|---|---|---|---|
| 135(a)-135(d) | 1N4002 | 151 | 113K |
| | | 128 | 100K |
| 179(a),179(b), 189(a),189(b), 169,170,172,173 165,166 | 1N914 | 158,162 | 1M |
| | | Current Transformer Ratio | |
| | | 74,98 | 200 to Stepdown |
| Capacitors | | Voltage Supplies | |
| 14,130 | .01 uf | $S_1$,N | 14 volts (Peak) |
| 134 | .1 uf | $S_2$,N | half-wave rectified |
| 136 | 4700 uf | | ac sine wave |
| | | $V_{DD}$ | 5.6 volts(dc) |
| | | $V_{AN}$ | 12 volts (dc) |

CONTROL PROGRAM

Microprocessor 102 is customized to control the sensor and display system by permanently configuring the Read Only Memory (ROM) of microprocessor 102 to implement predetermined control program instructions.

The primary function of microprocessor 102 relevant to the present invention is to monitor the outputs from the icemaker and defrost current sensor circuits 106 and 108, respectively and provide the appropriate display signals upon detection of a fault condition. For the sake of simplicity and brevity the description of the control program implemented by microprocessor 102 will be described on an essentially functional basis. It should be understood that the control program may include in addition to the control and diagnostic routines described herein, other routines to implement additional functions including monitoring functions such as monitoring the state of the refrigerator/freezer doors to alert the user if a door is left open.

The flow diagrams of FIGS. 8–16 illustrate the control program utilized to control the sensor and display system for refrigerator of FIG. 1. From these diagrams one of ordinary skill in the programming art could prepare a set of instructions for permanent storage in the Read Only Memory of microprocessor 102 to implement the control routine. It will be appreciated that instructions for carrying out the routine described in the flow diagrams of these figures may be interleaved with instructions and routines for other control features and functions as well.

It will be recalled from the description of the sensor and display circuitry of FIGS. 4–6 that the microprocessor inputs and outputs are multiplexed in synchronization with the 60 Hz power line signal. In the discussion to follow, operations conducted during positive half-cycles are referred to as Phase 1 operations and operations conducted during negative half-cycles are referred to as Phase 2 operations. To facilitate the multiplexing of the input and output signals, the Random Access Memory (RAM) of microprocessor 102 includes 2 four-bit G-input registers and 2 eight-bit L-output registers. One input register stores inputs received at ports GO-G3 during Phase 1 and the other stores inputs received at these ports during Phase 2. (Input port GO is not used in this embodiment; however it could be used to monitor other operating conditions such as the state of the compartment doors if desired.) One output register stores the Phase 1 output display code and the other stores the Phase 2 output display code. The Phase 1 output display code is the code output to ports $L_0$–$L_7$ during Phase 1. Similarly, the Phase 2 output code is the code that is output to ports $L_0$–$L_7$ during Phase 2. It will be recalled that ports $L_0$–$L_7$ control the left-hand digit of display 32 and the normal display 34 (FIG. 2) which are enabled during Phase 1; and the right-hand digit of display 32, normal display 34 and Warm Temperature Indicator LED 36 which are enabled during Phase 2.

The control program is executed once each half-cycle of the 60 Hz power signal with each pass through the program beginning upon detection of a zero crossing of the power signal. The function of the control program is to read in the data received at input ports G1–G3 and $I_0$, to process these inputs to determine if one or more fault conditions exist, and to provide the appropriate output display, that is, either the normal signal or the appropriate fault code alerting the user to the existence of a particular fault condition. The particular fault conditions detected by the sensor and display system include undesirable over-temperature condition in the freezer which, depending upon the particular nature of the fault, is signified by energizing the Warm Temperature LED or displaying the diagnostic code FF or both; a malfunction of the defrost heater signified by the diagnostic code DE; and a malfunction of the automatic icemaker signified by the fault diagnostic code CI.

Numerous flags and timers are utilized in the control program. Input flags which are set in response to input signals received at G1–G3 and $I_0$ include a 35° flag and a 55° flag, which are set in response to detection of freezer temperatures greater than 35° F. and 55° F. respectively; an IM ON flag set in response to detection of current in the icemaker circuit; a DE ON flag set in response to detection of current in the defrost heater; and a Key flag set in response to user actuation of the reset key 36 (FIGS. 2 and 4). Fault flags are set when timing information relating to how long or how frequently the input flags are set signifies a particular fault condition. The fault flags include a Warm Temperature flag which is set when the 35° flag remains set for 4 hours or the 55° flag remains set for 1 hour; an FF fault flag which is set when the 35° flag remains set continuously for 6 hours or the 55° flag remains set continuously for 2 hours; an IM fault flag which is set when the IM ON flag remains set continuously for 5 hours or the time between successive settings of the IM flag is less than 10 minutes for 3 consecutive times; and a DE fault flag which is set whenever the time between successive settings of the DE ON flag is greater than 48 hours.

The output display registers are encoded in accordance with the state of the fault flags. When more than one fault flag is set, a prioritizing routine establishes the relative priorities with the highest priority fault being displayed. When displaying one of the FF, IC and DE fault codes, display 32 is blinked on and off at ½ second intervals to provide a flashing display. When the Warm Temp flag is set, the Warm Temperature indicator is continuously illuminated. When no abnormal conditions are detected the normal indicia is illuminated.

Figure 8:
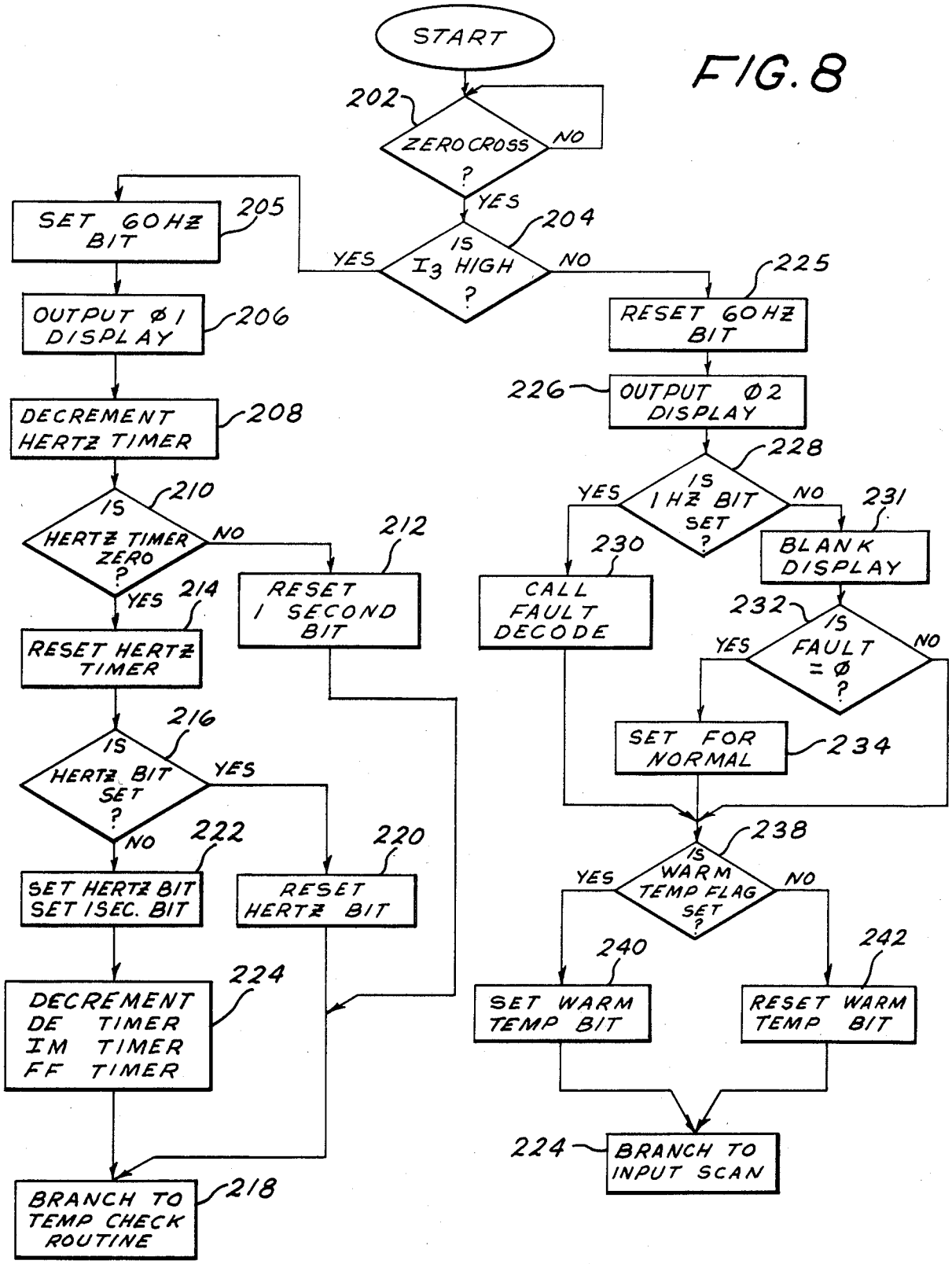
FIG. 8 is a flow diagram of the Start routine incorporated in the control program for the microprocessor in the circuit of FIG. 4.

Referring now to the flow charts of FIGS. 8–16 for the various routines, the control program will be described in greater detail beginning with the Start routine of FIG. 8. The function of this routine is to output the appropriate one of the Phase 1 and Phase 2 output display registers; to decrement the various timers utilized in other routines in the program; to reset as appropriate certain timing bits which are used for display timing purposes; and to update the output display registers.

Upon entering this routine, Inquiry 202 delays the program until the next zero crossing of the 60 Hz power signal is signified by a change in the state of the signal applied to input port $I_3$ from zero crossing detector circuit 140 (FIG. 4). Upon the detection of the zero crossing, Inquiry 204 determines whether the ensuing half-cycle is positive, Phase 1, or negative, Phase 2, by examining the input state at input port $I_3$. If $I_3$ is high, a bit designated the 60 Hz bit is set (Block 205) to indicate Phase 1 operation, and the data stored in the Phase 1 output storage register are output to the output ports $L_0$–$L_7$ (Block 206). Next a timer designated the Hertz timer is decremented (Block 208). The Hertz timer is a ½ second timer, which is initialized to 29. It is decremented at Block 208 every other half-cycle of the 60 Hz power signal. Hence, it is decremented to zero once every ½ second. Inquiry 210 checks the state of the Hertz timer to see if it has timed out. If not, a bit designated the one-second bit is reset (Block 212).

If the Hertz timer has timed out, then the timer is reset to 29 at Block 214. Next, a bit designated the One Hertz bit is checked by Inquiry 216. The One Hertz bit which toggles every half second is used to flash the diagnostic code display at ½ second intervals as will be described hereinafter. If this bit is set, it is reset (Block 220); if reset, it and the one second bit are set at Block 222 and several timers utilized in other routines yet to be described designated, the DE timer, the IM timer and the FF timer are decremented one count (Block 224). Since the Hertz timer times out at one-half second intervals, Blocks 222 and 224 are effective to set the Hertz bit and the one second bit at the beginning of each second, that is during the first positive line cycle of each one second interval and the various timers are decremented at a one second rate.

Figure 14:
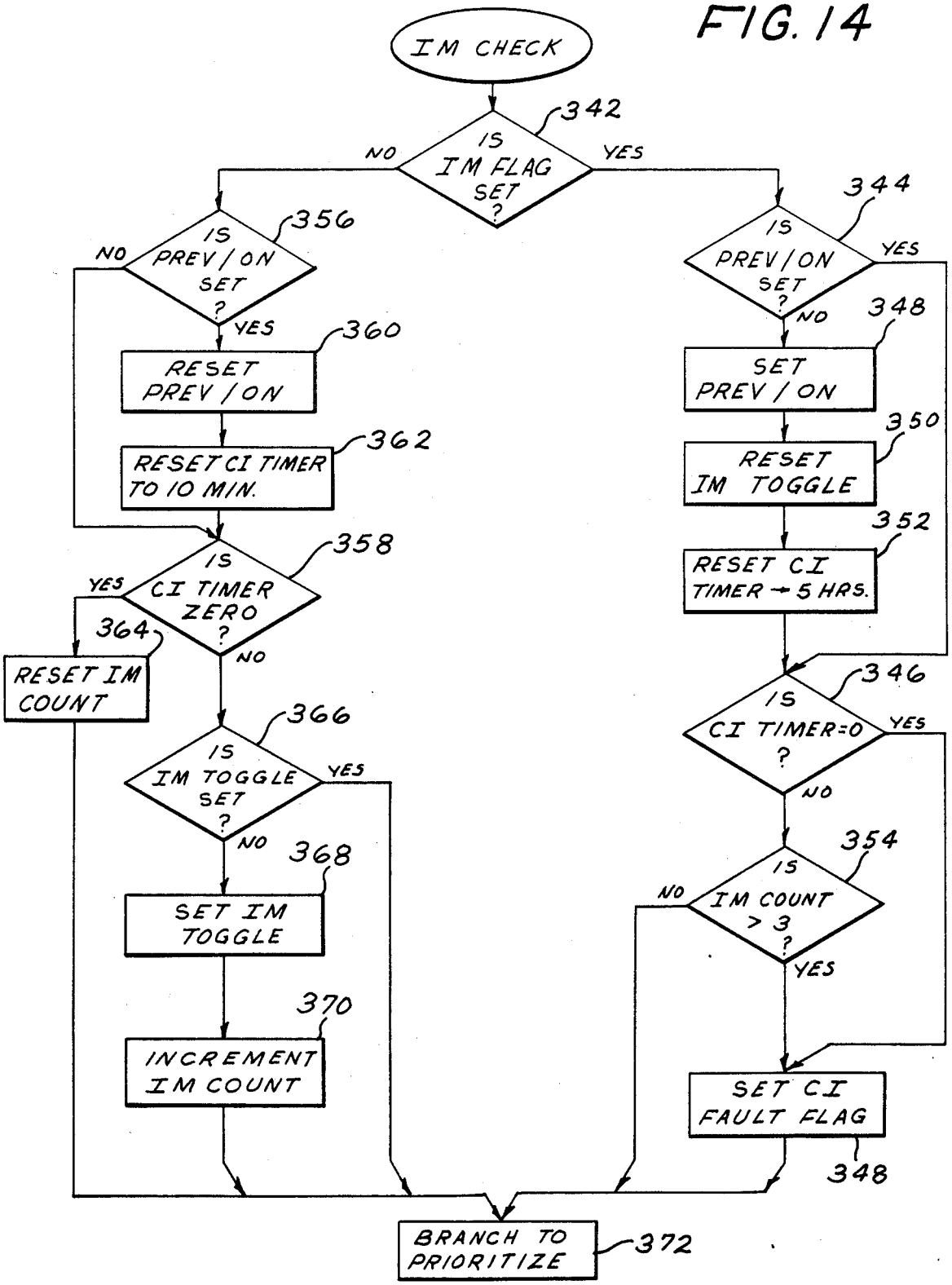
FIG. 14 is a flow diagram of the IM Check routine incorporated in the control program for the microprocessor in the circuit of FIG. 4.

Referring back to Inquiry 204, if the ensuing line cycle is a negative half-cycle signifying Phase 2 operation, the 60 Hz bit is reset signifying Phase 2 operation (Block 225). The data stored in output register for Phase 2 are output to output ports $L_0$–$L_7$ (Block 226) and Inquiry 228 checks the one Hertz bit. If the one Hertz bit is set, the Fault Decode sub-routine to be hereinafter described is called (Block 230). This sub-routine updates the Phase 1 and Phase 2 output registers. If the one Hertz bit is not set, the Phase 1 and Phase 2 output storage registers are encoded to blank the display during the next pass through the control routine (Block 231), and Inquiry 232 determines whether any fault condition has been detected during the previous pass through the routine. A variable designated Fault identifies the highest priority fault detected. If Fault equals 0, signifying no faults have been detected, then the output registers are encoded to energize the Normal display (Block 234). If Fault is not 0, the program proceeds to Inquiry 238. Since the one Hertz bit toggles at a ½ second rate, by this arrangement in the event a fault code is being displayed, Block 230 and Block 231 will be entered at alternate ½ second intervals, resulting in a flashing display which flashes at a ½ second rate. Inquiry 238 checks the state of the Warm Temp flag. If set, the Warm LED bit in the Phase 1 output register is set (Block 240). If the Warm Temp flag is not set, the Warm LED bit in the output register is reset (Block 242). The program then branches (Block 244) to the input scan routine (FIG. 14).

Figure 9:
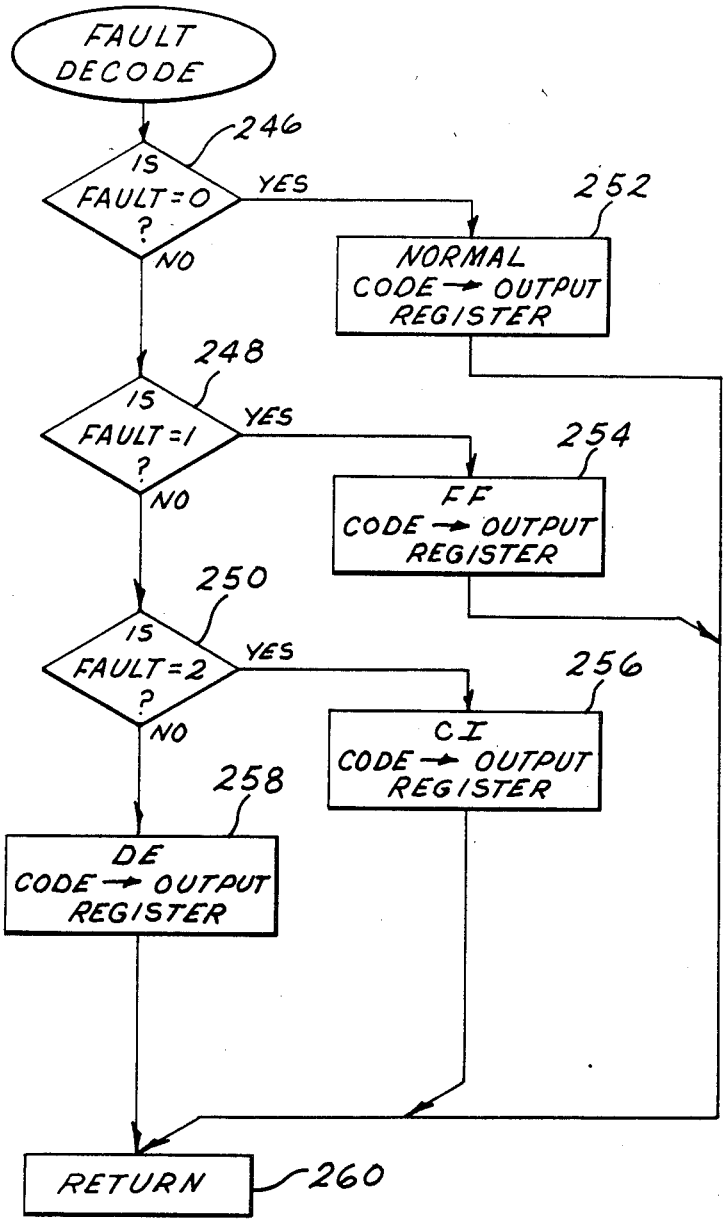
FIG. 9 is a flow diagram of the Fault Decode subroutine incorporated in the control program of the microprocessor in the circuit of FIG. 4.

The flow diagram for the Fault Decode sub-routine called at Block 230 (FIG. 8) is shown in FIG. 9. The function of this routine is to load the appropriate fault code in the output registers. The Fault variable is assigned a value in the Prioritizing routine (FIG. 12) hereinafter described, representing the highest priority fault detected. Values 0, 1, 2 and 3 represent the Normal condition, the frozen food fault condition FF, the icemaker fault condition CI, and the defrost fault condition DE respectively. Inquiries 246, 248 and 250 determine the value of the Fault variable and loads the appropriate output code into the output registers (Blocks 252, 254, 256, and 258). The program then returns (Block 260) to the Start routine at Block 230 (FIG. 8).

Figure 10:
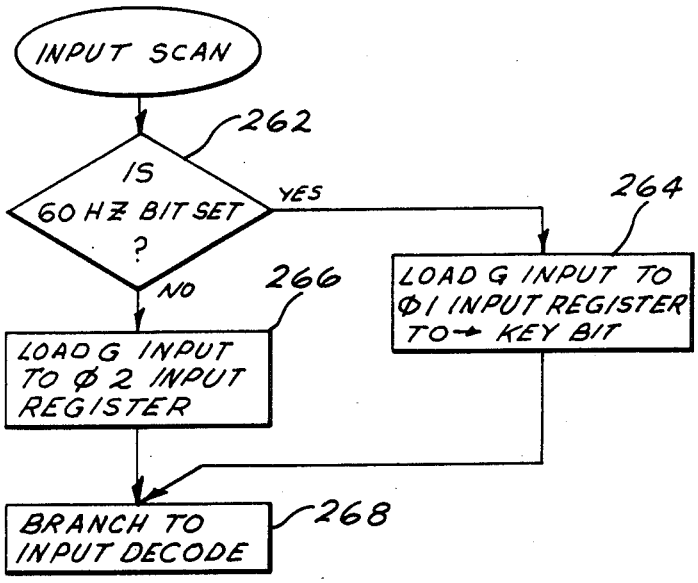
FIG. 10 is a flow diagram of the Input Scan routine incorporated in the control program of the microprocessor in the circuit of FIG. 4.
Figure 11:
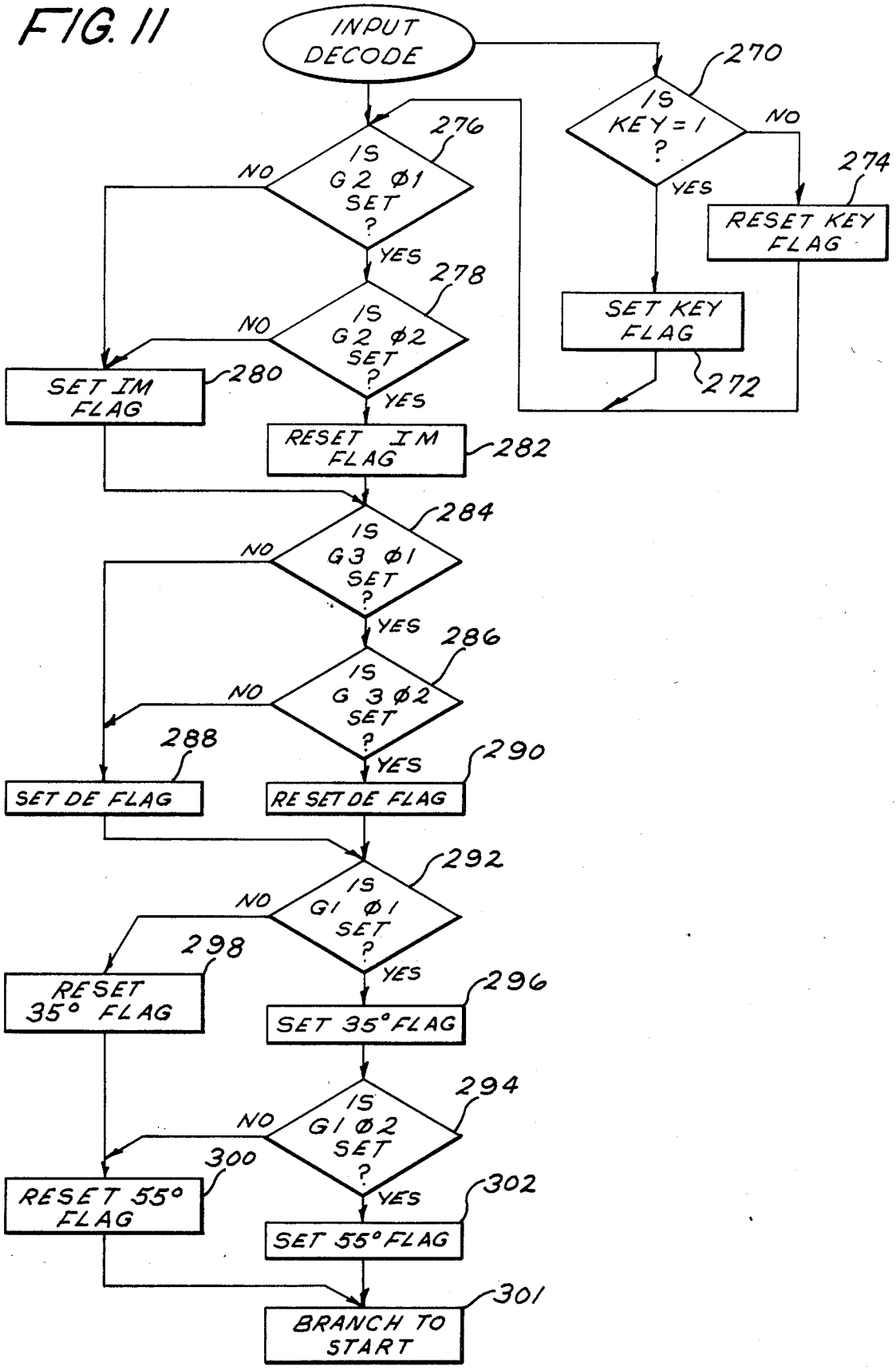
FIG. 11 is a flow diagram of the Input Decode routine incorporated in the control program of the microprocessor in the circuit of FIG. 4.

Referring next to FIG. 10, there is shown the flow diagram for the Input Scan routine which is entered from the Start routine (FIG. 8) when operating in Phase 2 and from the Reset Key routine to be hereinafter described (FIG. 15) when operating in Phase 1. The function of this routine is to transfer the data received at input ports G1, G2, G3 and $I_0$ to the appropriate Phase 1 or Phase 2 input register. Upon entering this routine Inquiry 262 determines if the 60 Hz bit is set signifying Phase 1 operation or reset signifying Phase 2 operation. If set, the data at the G input ports are stored in the Phase 1 input register and the input at $I_0$ updates the Key bit (Block 264). If the 60 Hz bit is reset, the G port inputs are loaded in the Phase 2 input register (Block 266). The program then branches (Block 268) to the Input Decode routine (FIG. 11).

The function of the Input Decode routine is to decode the Phase 1 and Phase 2 input registers and Key bit and set or reset the Key, IM, DE and 35° and 55° flags accordingly. Inquiry 270 checks the state of the Key bit and sets or resets the key flag accordingly (Blocks 272 and 274). The key flag signifies whether the reset key has been actuated. Inquiries 276 and 278 check the appropriate bit in the Phase 1 and Phase 2 input registers respectively to determine if the input at G2 was high or low. If either the Phase 1 or the Phase 2 bit is low, signifying the detection of current flowing to the icemaker circuit, the IM flag is set (Block 280). If both bits are high, the IM flag is reset (Block 282). Inquiries 284 and 286 check the state of the bit in the Phase 1 and Phase 2 input registers respectively representing the input received at G3. If either bit is low, signifying detection of current flow in the defrost heater circuit, the DE flag is set (Block 288). Otherwise, the DE flag is reset (Block 290). Inquiries 292 and 294 check the bits in the Phase 1 and Phase 2 input registers respectively, representing the inputs received at Gl. It will be recalled that a logic one input at Gl during Phase 1 signifies a sensed freezer temperature greater than the 35° reference temperature. Hence, if the Phase 1 bit is set, the 35° flag is set (Block 296). If the Phase 1 bit is reset signifying a sensed temperature less than 35° F., the 35° flag is reset (Block 298), and the 55° flag is reset (Block 300) and the program returns (Block 301) to the Start routine (FIG. 8). If the Phase 1 temperature bit is set, Inquiry 296 checks the Phase 2 bit. It will be recalled that if the input at Gl is high during Phase 2, this indicates a sensed freezer temperature greater than the 55° F. reference. Hence, if the Phase 2 temperature bit is set, the 55° flag is set (Block 302). Otherwise, the 55° flag is reset (Block 300) and the program returns (Block 301) to the Start routine (FIG. 8) to await the start of the next pass through the control program.

Figure 12:
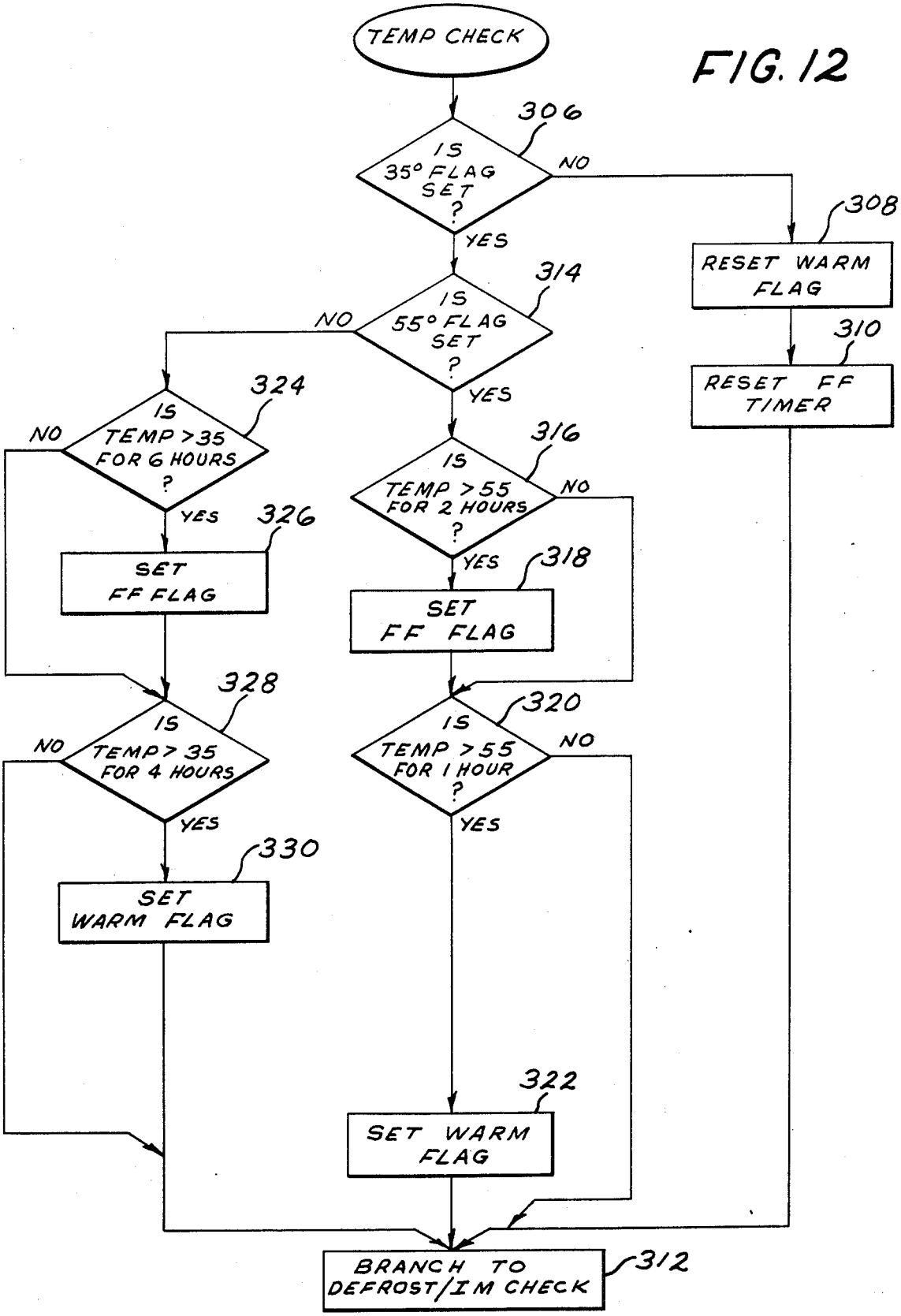
FIG. 12 is a flow diagram of the Temp Check routine incorporated in the control program of the microprocessor in the circuit of FIG. 4.

The flow diagram for the Temp Check routine is shown in FIG. 12. The function of this routine, which is entered from the Start routine during Phase 1 operations, is to monitor the duration of any sensed over-temperature condition and set the appropriate Warm or Frozen Food fault flags as appropriate in accordance with the present invention. More specifically, the Warm flag will be set to ultimately energize the Warm Indicator light when the sensed freezer temperature exceeds the 35° F. reference temperature for more than 4 hours or the 55° F. reference temperature for more than 1 hour. The Warm flag, once set, remains set until the sensed temperature drops below 35° F.

Additionally, the FF fault flag is set to ultimately display the FF diagnostic code if the sensed temperature exceeds 35° F. for 6 hours or 55° F. for 2 hours. The FF flag, once set, remains set until reset by user actuation of the Reset Key 36 (FIG. 2).

Figure 13:
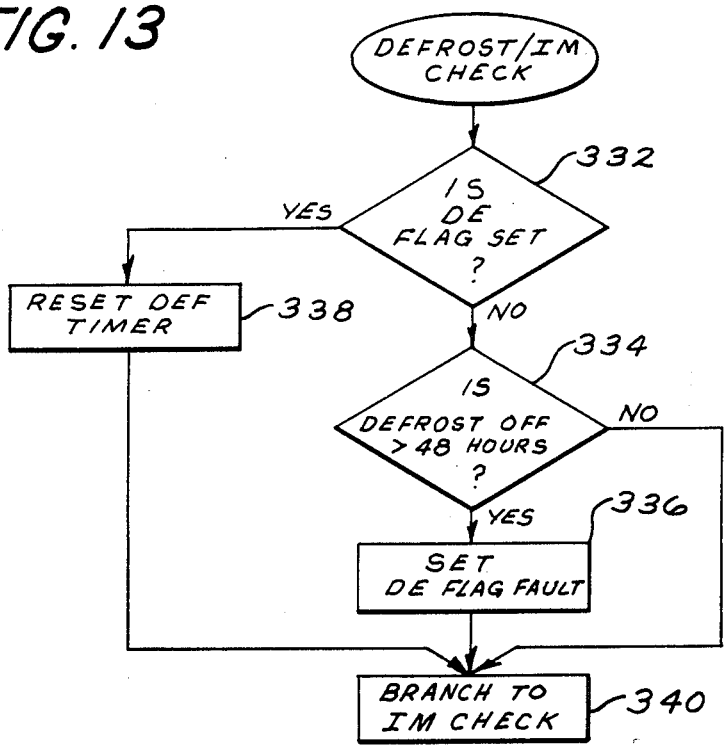
FIG. 13 is a flow diagram of the Defrost Check routine incorporated in the control program of the microprocessor in the circuit of FIG. 4.

On entering the routine, Inquiry 306 checks the 35° flag. If not set, the Warm flag is reset (Block 308), the Frozen Food timer is reset (Block 310), and the program branches (Block 312) to the Defrost Check routine (FIG. 13). If the 35° flag is set signifying a sensed temperature greater than the 35° F. reference temperature, Inquiry 314 determines whether the 55° flag is set signifying a Frozen Food temperature greater than the 55° F. reference temperature. If set, Inquiry 316 checks the Frozen Food timer to determine if the flag has been set for a time period greater than 2 hours. If yes, the FF fault flag is set (Block 318). Otherwise, the program simply proceeds to Inquiry 320 which determines if the FF flag has been set for a one hour period. If not, the program branches (Block 312) to the Defrost Check routine (FIG. 13). If the flag has been set for more than one hour, the Warm flag is set (Block 322) and the program branches (Block 312) to the Defrost Check routine. Referring back to Inquiry 314, if the 55° flag is not set signifying a temperature greater than 35° and less than 55°, Inquiry 324 determines if the 35° flag has been set for greater than six continuous hours. If so, the FF fault flag is set (Block 326). The program then proceeds to Inquiry 328 which determines if the 35° flag has been set for continuous period of more than four hours. If yes, the Warm flag is set (Block 330). The program then proceeds (Block 312) to the Defrost Check routine (FIG. 13).

The function of the Defrost Check routine is to monitor the duration of time between defrost cycles by monitoring the time between defrost current "on" signals to detect a defrost circuit malfunction. Referring now to the flow diagram of FIG. 13, Inquiry 332 checks the state of the DE flag. It will be recalled that the DE flag is set or reset in the Input Decode routine (FIG. 11) depending upon whether or not current flow is sensed in the defrost circuit. If reset, signifying that the defrost heater is not energized, Inquiry 334 checks the defrost timer to determine if the defrost heater has been off for a period greater than 48 hours. If the heater has been off for more than 48 hours, the DE fault flag is set (Block 336). Referring again to Inquiry 332, if the DE flag is set, signifying that the current is flowing in the defrost heater, the defrost timer is reset (Block 338). The program then branches (Block 340) to the IM Check routine (FIG. 14).

The function of the IM Check routine is to monitor the duration of continuous on time for the icemaker circuit to detect a blocked or stalled icemaker condition and to monitor the time between successive on periods of the icemaker circuit which if too short signifies a malfunction of the icemaker. Specifically, for purposes of the illustrative embodiment this routine determines if current is flowing in the icemaker circuit continuously for a time period greater than 5 hours, or if the time between successive icemaker on periods is less than 10 minutes on 3 consecutive occasions. Upon detection of either condition, the CI fault flag is set, signifying the existence of an icemaker fault condition.

Referring to the flow diagram in FIG. 14, Inquiry 342 checks the state of the IM flag. It will be recalled that the IM flag is set or reset in the Input Decode routine (FIG. 11) depending upon whether or not current is detected in the icemaker circuit. If set, signifying that the icemaker is on, Inquiry 344 checks a flag designated the Prev/on flag which if set indicates that during the previous pass through the control program the icemaker was on and which if reset signifies that during the previous pass through the control program the icemaker was off. If set, the program proceeds to Inquiry 346. If reset, signifying that the icemaker has just been turned on, the Prev/on flag is set (Block 348), and a flag designated the IM toggle flag is reset (Block 350). The toggle flag, which is set during icemaker on periods and reset during off periods, is used to identify the first pass through this routine during each on and off period. Next the icemaker timer is reset to 5 hours (Block 352). During icemaker on periods, the icemaker timer functions as an ON timer monitoring the duration of the "on" periods. Inquiry 346 checks the icemaker timer to see if the 5 hour time period has timed out. If so, the icemaker has been on for a period in excess of 5 hours and the CI fault flag (Block 348) is set. If the CI timer has not timed out, Inquiry 354 checks the state of a counter designated the IM Count counter which keeps track of how many successive attempts have been made to turn the icemaker on at less than 10 minute intervals as will be hereinafter described. If the IM count is greater than 3, the CI fault flag is set (Block 348).

Figure 15:
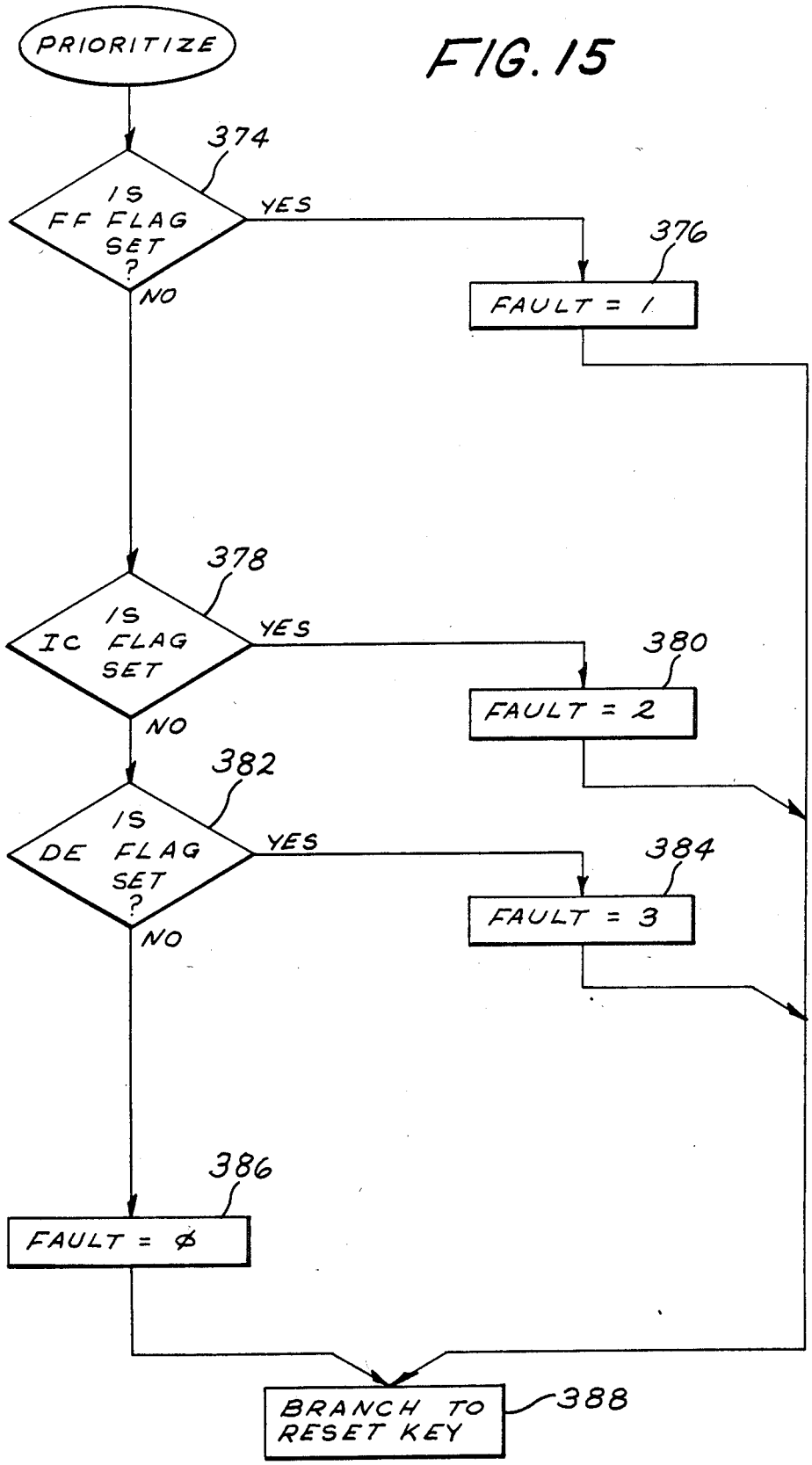
FIG. 15 is a flow diagram of the Prioritize routine incorporated in the control program of the microprocessor in the circuit of FIG. 4.

Referring back to Inquiry 342, if the IM flag is reset signifying that the icemaker is off, Inquiry 356 checks the Prev/on flag. If reset, signifying that the icemaker has been off, program proceeds to Inquiry 358. If set, signifying that the icemaker has just turned off, the prev/on flag is reset (Block 360) and the CI timer, which during icemaker off periods functions as an OFF timer, is set to 10 minutes (Block 362). Inquiry 358 checks to determine if the CI timer has been decremented down to 0, signifying an off time greater than 10 minutes. If yes, the IM counter is reset (Block 364). If not, Inquiry 366 checks the toggle flag. If reset, signifying the first pass through the IM Check routine since the icemaker was turned off, the IM toggle flag is set (Block 368) and the IM Count counter is incremented (Block 370). Since this portion of the routine is only entered during the first pass through this routine during each off period, the IM Counter is incremented once during each off period. Since the counter is only reset if the off period exceeds 10 minutes, the IM Counter counts successive attempts to start the icemaker following off times of less than 10 minutes. As previously described, Inquiry 354 and Block 348 set the CI fault flag if the IM Count exceeds 3. On completion of the routine the program then branches (Block 372) to the Prioritize routine (FIG. 15).

Figure 16:
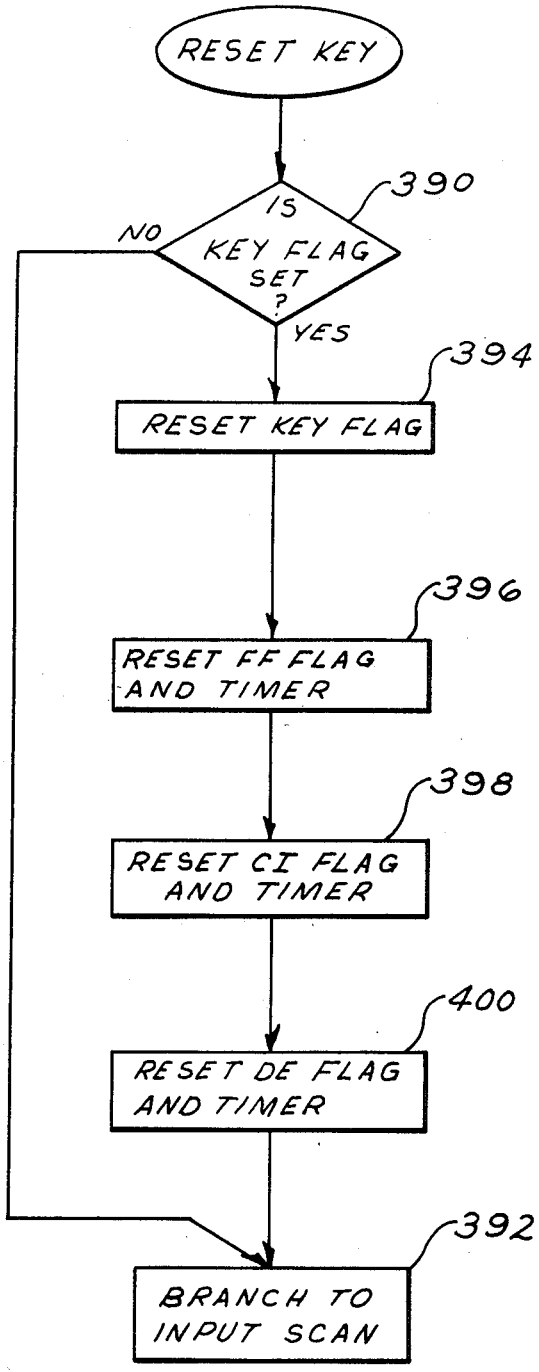
FIG. 16 is a flow diagram of the Reset Key routine incorporated in the control program of the microprocessor in the circuit of FIG. 4.

The function of the Prioritize routine is to assign priority values to the faults in the event that more than one fault has been detected. The descending order of priority as follows: frozen food fault, icemaker fault, and defrost fault. Only the highest priority fault will be displayed. Referring now to the flow diagram of FIG. 15, Inquiry 374 determines if the frozen food fault flag has been set. If so, the priority variable designated Fault is set equal to 1 (Block 376). If the frozen food flag is not set, Inquiry 378 checks the state of the IC icemaker fault flag. If set, Fault is set equal to 2 (Block 380). If not set, Inquiry 382 checks the state of the defrost fault flag. If set, Fault is set equal to 3 (Block 384). If not set, Fault is set equal to 0, signifying that none of the fault conditions have been detected (Block 386). The program then proceeds to the Reset Key routine (Block 388) (FIG. 16).

The function of the Reset Key routine is to reset the various fault flags and timers in response to user actuation of the reset key 36 (FIG. 2). It will be recalled that the FF, CI and DE fault flags, once set, are only to be reset by user actuation of the Reset Key to insure that the user is alerted that a fault condition was detected even if the condition no longer persists. Referring to the flow diagram of FIG. 16, Inquiry 390 determines if the Key flag is set. If not, the program branches (Block 392) to the Input Scan routine (FIG. 10). If set, the Key flag is reset (Block 394). Blocks 396 and 400 reset the frozen food fault flag and timer, the icemaker fault flag and timer, and the defrost fault flag and timer respectively. The program then branches (Block 392) to the hereinbefore described Input Scan routine of FIG. 10.

From the foregoing it will be apparent that an improved diagnostic system for refrigerator/freezer and freezer appliances is provided which provides a timely warning signals to alert the user to the presence of fault conditions in the icemaker circuit, which preclude normal operation of the affected circuit and which if uncorrected may interfere with proper refrigeration performance.

While a specific embodiment of the invention has been illustrated and described herein, it is realized that numerous modifications and changes will occur to those skilled in the art. For example, in the illustrative embodiment visually discernible signals are displayed. It will be appreciated that audible signals could be employed in lieu of or in addition to the visual signals to alert the user to fault conditions. It is therefore to be understood that the appended claims are intended to cover all such modifications and changes which fall within the true spirit and scope of the invention.

What is claimed is:

1. In an appliance having a freezer compartment containing an icemaker of the type having an ice forming mold and an electric motor and mold heater which are energized by an external power supply during ice cube ejection cycles initiated upon detection of frozen cubes in the mold and de-energized upon completion of the ejection cycle, an icemaker diagnostic arrangement comprising:

current sensing means operative to generate an "on" signal whenever the icemaker motor and mold heater are energized; and logic circuit means including timing means for measuring the elapsed time between successive "on" signals and signal means operative to generate a user discernible signal signifying a malfunction of the icemaker when an elapsed time less than that normally required to freeze cubes in the mold is detected.

2. The diagnostic arrangement of claim 1 wherein said timing means is further operative to measure the duration of said "on" signals and said display means is further operative to generate said user discernible signal when a duration of an "on" signal is greater than that normally required to complete an ejection cycle.

3. In an appliance having a freezer compartment containing an icemaker of the type having an ice forming mold and circuitry including an electric motor and mold heater which circuitry energized by an external power supply during an ice cube ejection cycle initiated upon detection of frozen cubes in the mold and de-energized upon completion of the ejection cycle, an icemaker diagnostic arrangement comprising:

logic circuit means including timing means for measuring the time between successive "on" signals to detect the occurrence of a time between successive "on" signals less than the normal minimum time required to freeze cubes in the mold;

means for counting consecutive ones of said occurrences; and display means operative to display fault code signifying an icemaker fault upon the occurrence of a predetermined number of consecutive ones of said occurrences, whereby the user is informed of a malfunction of the icemaker.

4. The diagnostic arrangement of claim 3 wherein said timing means is further operative to measure the duration of said "on" signals and said display means is further operative to generate said fault code upon detection of an "on" signal duration greater than that normally required to complete an ejection cycle.

5. An icemaker fault detection arrangement for an appliance having a freezer compartment containing an icemaker having a cube forming mold, icemaker circuitry including an electric motor and mold heater which circuitry is energized to eject ice cubes from the mold when frozen and de-energized following completion of the ice cube ejection cycle, said fault detection arrangement comprising:

current sensing means operative to generate an "on" signal whenever the icemaker circuitry is energized;

timing means responsive to said current sensing means operative to measure the duration of each "on" signal and to measure the duration of time between consecutive "on" signals;

means for comparing the duration of each "current on" signal to a first reference time greater than the normal duration of a cube ejection cycle; and for comparing the duration of time between "on" signals to a second reference time less than the time normally required to freeze water in the mold; and means responsive to said comparing means operative to generate a user discernible signal signifying an icemaker fault upon detection of either an "on" signal of greater duration than said first reference time or a predetermined number of consecutive occurrences of a period between "on" signals less than said second reference time; whereby the user is informed that the icemaker is not operating properly.

6. A method for detecting icemaker fault conditions in a refrigeration appliance having an automatic icemaker of the type comprising an ice cube forming mold, and icemaker circuitry including an electric motor and mold heater which circuitry is energized by an external power supply to eject ice cubes from the mold when frozen and de-energized upon completion of the ice cube ejection cycle, said method comprising the steps of:

sensing the current in the icemaker circuitry and generating an "on" signal when current is detected;

measuring the duration of the "on" signals; and generating a user discernible signal when the duration of an "on" signal exceeds a reference time longer than the time normally required to complete an ejection cycle.

7. The method of claim 6 further comprising the steps of:

measuring the duration of time between "on" signals; and generating a user discernible signal when the time between "on" signals is less than a reference time less than the normal minimum time for cubes to form in the mold.

8. The method of claim 6 further comprising the steps of:

measuring the duration of time between "on" signals;

counting successive occurrences of times between "on" signals less than a reference time less than the minimum time normally required for cubes to form in the mold; and generating a user discernible signal when the number of successive occurrences exceeds a predetermined number.

9. A method for detecting icemaker fault conditions in a refrigeration appliance having an automatic icemaker of the type comprising an ice cube forming mold, and icemaker circuitry including an electric motor and mold heater which circuitry is energized by an external power supply to eject ice cubes from the mold when frozen and de-energized upon completion of the ice cube ejection cycle, said method comprising the steps of:

sensing the current in the icemaker circuitry and generating an "on" signal when current is detected;

measuring the time between "on" signals; and generating a user discernible signal when the time between "on" signals is less than the minimum normal time for cubes to form in the mold.

10. The method of claim 9 further comprising the steps of:

measuring the duration of the "on" signals; and generating a user discernible signal when the duration of an "on" signal exceeds the maximum time normally required to complete an ejection cycle.

* * * * *